US005778513A

United States Patent [19]

Miu et al.

[11] Patent Number: 5,778,513

[45] Date of Patent: Jul. 14, 1998

[54] BULK FABRICATED ELECTROMAGNETIC MICRO-RELAYS/MICRO-SWITCHES AND METHOD OF MAKING SAME

[75] Inventors: Denny K. Miu, 25873 Anzio Way, Valencia, Calif. 91135; Weilong Tang, Alhambra; Viktoria A. Temesvary, Culver City, both of Calif.

[73] Assignee: Denny K. Miu, Valencia, Calif.

[21] Appl. No.: 599,018

[22] Filed: Feb. 9, 1996

[51] Int. Cl.[6] ..... H01F 4/14; H01H 15/00

[52] U.S. Cl. ..... 29/602.1; 29/605; 29/831; 335/78; 361/283.1; 361/819

[58] Field of Search ..... 361/283.1, 684, 361/792, 803, 819; 29/602.1, 605, 831, 841, 827; 335/78, 79, 80

[56] References Cited

U.S. PATENT DOCUMENTS

| | | | |
|---|---|---|---|
| 4,429,349 | 1/1984 | Zachary | 29/831 |
| 4,826,131 | 5/1989 | Mikkor | 251/129 |
| 5,025,346 | 6/1991 | Tang et al. | 361/283.1 |
| 5,153,543 | 10/1992 | Hitachi et al. | 335/78 |
| 5,374,792 | 12/1994 | Ghezzo et al. | 200/16 |
| 5,398,011 | 3/1995 | Kimura et al. | 361/819 X |
| 5,472,539 | 12/1995 | Saia et al. | 156/155 |
| 5,475,353 | 12/1995 | Roshen et al. | 335/78 |

FOREIGN PATENT DOCUMENTS

| | | | |
|---|---|---|---|
| 0 573 267 | 12/1993 | European Pat. Off. | H01H 1/00 |
| 0 685 864 | 12/1995 | European Pat. Off. | H01H 51/26 |
| 2 215 914 | 9/1989 | United Kingdom | H01H 35/34 |

OTHER PUBLICATIONS

Patent Abstracts of Japan—vol. 014, No. 381 (P-1093), 16 Aug. 1990 & JP 02 141912 A (Yamaha Corp), 31 May 1990, see abstract.

Patent Abstracts of Japan—vol. 014, No. 165 (P-1030), 30 Mar. 1990 & JP 02 021414 A (NEC Corp), 24 Jan. 1990, see abstract.

Hosaka, et al. "Electromagnetic microrelays: concepts and fundamental characteristics", *Sensors and Actuators*, A. 40, 1994, pp. 41–47.

Drake, et al. "An Electrostatically actuated Micro-Relay", Transducers '95—Eurosensors IX, 329–B10, 4 pages.

Yao, et al. A Surface Micromachined Miniature Switch for Telecommunications Applications with Signal Frequencies From DC to 4 GHZ, Transducers '95—Eurosensors IX conference Sweden, 1995, pp. 384–387.

O'Connor, "Miniature Motors for Future PCS", *Mechanical Engineering*, 1995, pp. 63–65.

Coughlin, et al. "Design Trends in Head/gimbal Assemblies for hard-disk drives", May/Jun. 1995 Data Storage, pp. 23–31.

Tang, et al. "Silicon Micromachined Electromagnetic Microactuators for Rigid Disk Drives", Intermag Conference of 1995, pp. 1–3.

Miu, et al. "Silicon Micromachined SCALED* Technology", *IEEE*, 1995, pp. 234–239.

(List continued on next page.)

*Primary Examiner*—W. Donald Bray
*Attorney, Agent, or Firm*—Skjerven, Morrill, MacPherson, Franklin & Friel LLP

[57] ABSTRACT

A micro-relay has a flexible monocrystalline structure which is moved by an electromagnetic force to establish a connection between relay contact elements. The micro-relay includes a substrate having a magnetic pathway and one or more coils located over the magnetic pathway. A first contact pad is coupled to the substrate. The monocrystalline structure is suspended over the substrate. A second contact pad and pole pieces are coupled to the monocrystalline structure such that the second contact pad is positioned over the first contact pad, and the pole pieces are located over the coils. A current is applied to the coils to generate an electromagnetic force which flexes the monocrystalline structure toward the substrate, thereby causing the second contact pad to touch the first contact pad. In one embodiment, the coils include insulating spacers located adjacent to the innermost and outermost traces to prevent shorting.

35 Claims, 23 Drawing Sheets

OTHER PUBLICATIONS

Miu, et al, "Silicon Microstructures and Microactuators for Compact Computer Disk Drives", *IEEE*, 1994, pp. 52–57.
Miu, "Silicon Microactuators for Rigid Disk Drives", *Data Storage*, Jul./Aug. 1995, pp. 33–40.
Ahn, et al, "A Fully Integrated Micromagnetic Actuator With a Multilevel Meander Magnetic Core", *IEEE*, 1992, p. 18.
Miu, et al, "Silicon Microgimbals for Super–Compact Magnetic Recording Rigid Disk Drives", *ISSN*, 1993, pp. 139–152.
Temesvary, et al, "Design, Fabrication, and Testing of Silicon Microgimbals for Super–Compact Rigid Disk Drives", *Journal of Microelectromechanical Systems*, vol. 4, No. 1, 1995 Mar., pp. 18–27.

BULK FABRICATED ELECTROMAGNETIC MICRO-RELAYS/MICRO-SWITCHES AND METHOD OF MAKING SAME

FIELD OF USE

The present invention relates to a micro-relay which performs mechanical switching in response to an externally applied electrical current. This invention also relates to techniques for fabricating such a micro-relay.

BACKGROUND ART

In many industrial applications, mechanical relays are used instead of solid-state switches because relays provide better isolation when turned off, and provide a lower resistance when turned on. In addition, mechanical relays do not have parasitic capacitance which can cause signal delay in high-frequency applications. However, conventional relays are relatively large, have relatively high power consumption and have relatively slow switching speeds. Moreover, conventional relays are typically difficult and costly to fabricate.

In addition to conventional mechanical relays, there are also micro-relays which are fabricated using batch processes similar to those used for manufacturing microelectronics. However, existing micro-relays use structural materials which include sputtered or evaporated metal, electroplated metal, vacuum-deposited polysilicon and vacuum-deposited silicon nitride. As used herein, the term "structural material" refers to the material which is moved to make or break connections between the contact elements of the relay. The stiffness, durability, fatigue and deformation characteristics of the previously listed structural materials are sub-optimal.

Certain micro-relays generate an electrostatic force which is used to move the structural material. This electrostatic force is typically relatively small (e.g., on the order of a nano-Newton). As a result, the relay contact elements must be positioned relatively close together. This close spacing results in low relay breakdown voltage, tight manufacturing tolerances and low shock resistance. The small electrostatic force also requires the structural material to have a relatively low stiffness. This results in slower switching speed, which in turn can cause arcing between the relay contact elements during switch opening. In general, the means which generate the electrostatic forces are susceptible to particle contamination.

On the other hand, conventional miniaturized reed relays use parallel permalloy reeds which are electrically magnetized to generate an actuating force which causes the reeds to join. A second electrical current (signal) is passed through the conductive path formed by the joined reeds. Thus, in these reed relays, the magnetic path is identical to the electrical path. When the electrical signal has a high frequency (e.g., greater than 50 MHz), signal loss is appreciable because of the skin-effect associated with the permalloy reeds (i.e., the electrons are confined to travel only on the skin of reeds).

It would therefore be desirable to have a micro-relay which (1) has a structural material having superior stiffness, durability, fatigue and deformation characteristics, (2) generates actuating forces which are greater than those forces typically generated by electrostatic means, (3) eliminates the skin-effect associated with electromagnetic reed relays, (4) can be fabricated at low cost and with batch manufacturing processes similar to those of microelectronics, (5) can be fabricated on a substrate with other microelectronic elements, (6) can be fabricated to operate as an array on a single substrate in order to perform desired routing and multiplexing operations.

SUMMARY

Accordingly, the present invention provides a micro-relay which uses a monocrystalline material, such as monocrystalline silicon, as the structural material. Monocrystalline silicon has advantageous stiffness, durability, fatigue and deformation characteristics. The silicon is moved by electromagnetic forces to provide an electrical connection between relay contact elements. The elements which generate the electromagnetic forces are separate from the elements used to make the electrical connection. As a result, the skin-effect associated with reed relays is eliminated.

In one embodiment, the micro-relay includes a substrate having at least one magnetic pathway located therein. The substrate can be, for example, a ferromagnetic substrate or a silicon substrate having a trench filled with ferromagnetic material. One or more coils are located on the substrate over the magnetic pathways, such that a current applied to the coils magnetizes the magnetic pathways. One or more contact pads are located over the substrate. These contact pads are electrically insulated from one another, thereby providing a normally open electrical circuit within the micro-relay.

A flexible monocrystalline structure is suspended over the substrate. The monocrystalline structure has a typical thickness of 30 μm. An electrically conductive bridge pad is connected to the monocrystalline structure such that the bridge pad is positioned above the contact pads. When the monocrystalline structure flexes toward the substrate, the bridge pad touches the contact pads, thereby providing a closed electrical connection between the contact pads.

Pole pieces are connected to the monocrystalline structure such that the pole pieces are located above the coils. The pole pieces can be made from a ferromagnetic material or from a permanent magnet material. A current applied to the coils generates an electromagnetic force which pulls the monocrystalline structure toward the substrate, thereby causing the bridge pad to touch the contact pads.

In one variation, the monocrystalline structure is continuous. In another variation, the monocrystalline structure is machined into simple beams. In another variation, the monocrystalline structure includes a frame portion which extends about the perimeter of the monocrystalline structure, a platform portion which is laterally surrounded by the frame portion, and a plurality of spring elements connecting the frame portion to the platform portion. The bridge pad and the pole pieces are located on the platform portion. The spring elements can have, for example, a serpentine shape. The invention also includes methods of operating and fabricating the above described micro-relays.

The present invention is further directed to an improved coil structure utilizing reinforced adjacent insulating spacers (RAILS). A coil in accordance with the invention includes a winding layer located over a substrate. The winding layer has an innermost trace and an outermost trace. A first reinforced insulating spacer is located adjacent to the innermost trace of the winding layer, and a second reinforced insulating spacer is located adjacent to the outermost trace of the winding layer. An insulating layer is located over the winding layer and the first and second spacers. The reinforced insulating spacers ensure that the innermost and outermost traces of the winding layer do not short to any subsequent winding layers within the coil. Reinforced insulating spacers can be located adjacent to the innermost and outermost traces of each winding layer of the coil. Without the reinforced insulation spacers, any insulation layer (e.g., photoresist or polyimide) that is deposited over the winding layer tends to be very thin around the corners of the innermost and outermost traces, thereby causing shortage between the various winding layers. This is a problem for many electromagnetic devices having planar coil structures, especially when there are more than two winding layers. This is also a problem for electromagnetic actuators where the winding layers tend to be thick to provide a substantial current carrying capacity. In a particular embodiment, the insulating spacers are made from photoresist. However, the spacers can also be made from other materials, such as polyimide or oxide.

A method of fabricating a coil in accordance with the invention includes the steps of: (1) forming a photoresist layer over the substrate, (2) exposing the photoresist layer through a first reticle (mask) which defines the winding layer, (3) developing the photoresist layer to form an opening in the photoresist layer, (4) forming an electrically conductive material in the opening, thereby forming the winding layer, (5) exposing the photoresist layer through a second reticle which defines the first and second reinforced insulating spacers, and (6) developing the photoresist layer, thereby leaving remaining portions of the photoresist layer as the first and second spacers. The remaining portions of the photoresist layer can optionally be baked to fully harden the first and second spacers.

The present invention will be more fully understood in light of the following detailed description taken together with the drawings.

DETAILED DESCRIPTION

Figure 1:
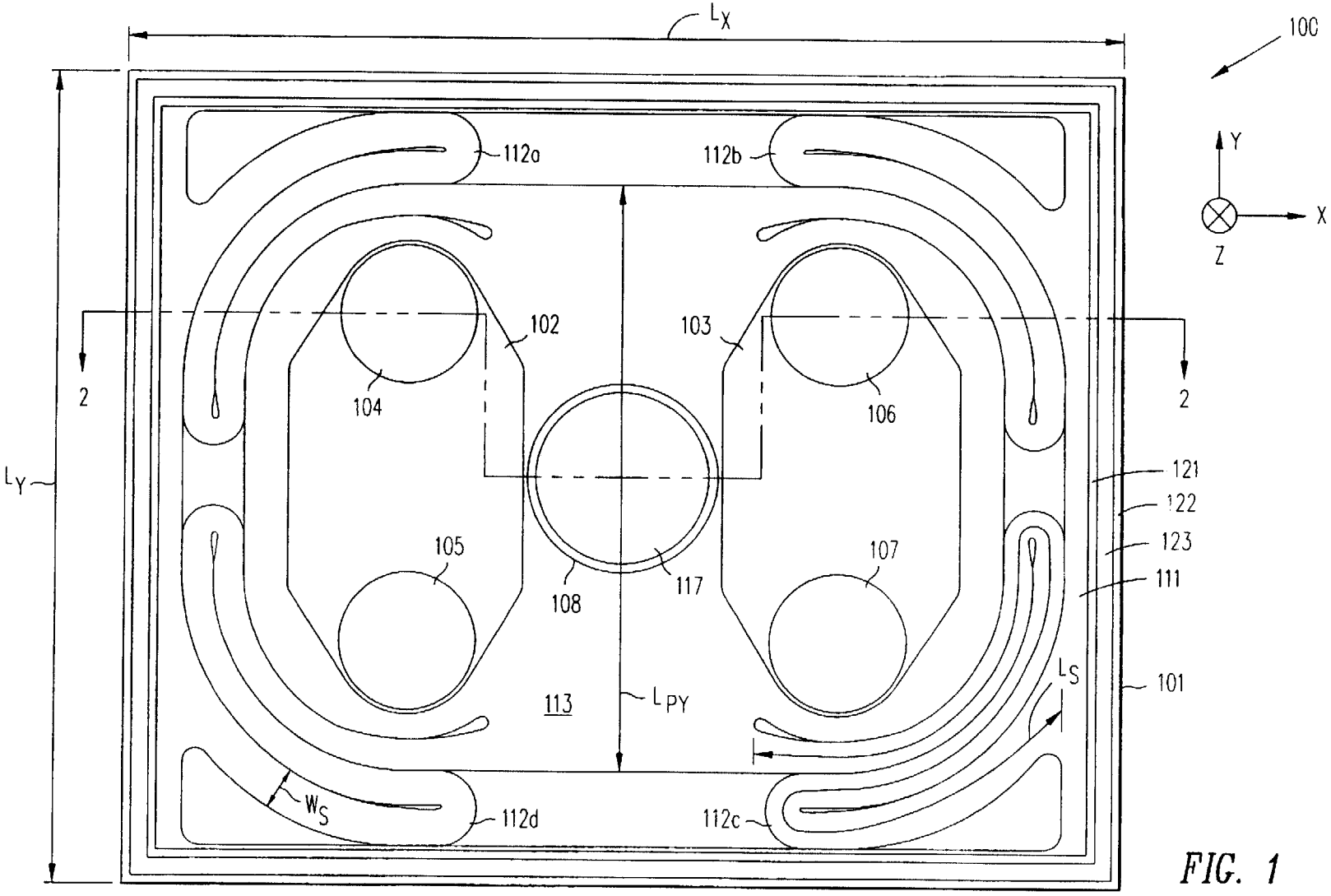
FIG. 1 is a bottom view of an upper structural member in accordance with one embodiment of the invention.
Figure 2:
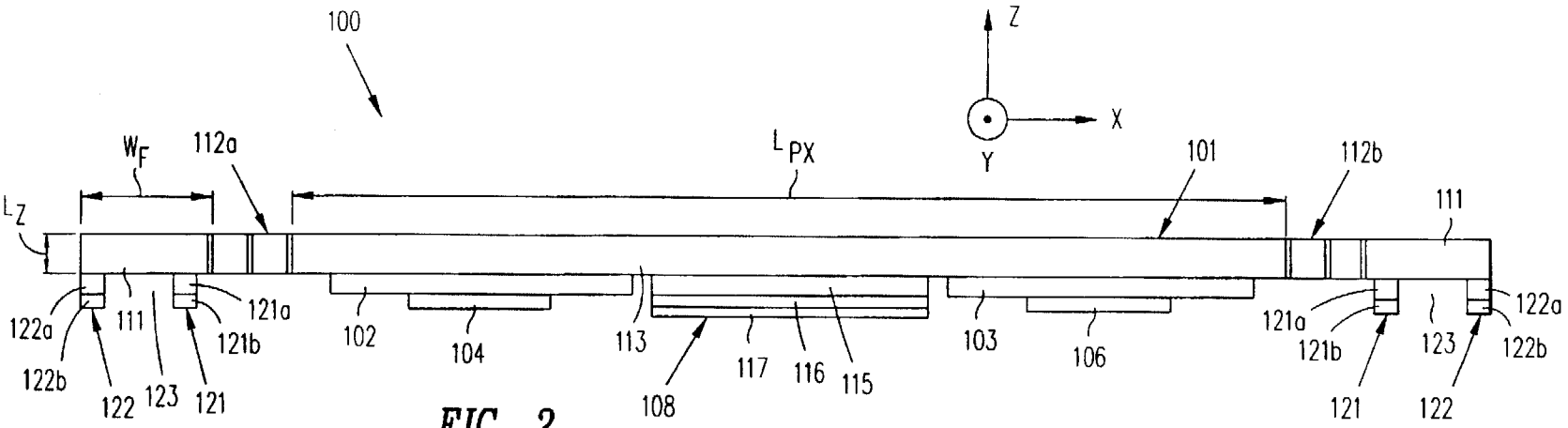
FIG. 2 is a cross sectional view of the upper structural member of FIG. 1 along section line 2—2 of FIG. 1.

FIG. 1 is a bottom view of an upper structural member 100 in accordance with one embodiment of the invention. FIG. 2 is a cross sectional view of upper structural member 100 along section line 2—2 of FIG. 1. FIGS. 1 and 2 use the illustrated X-Y-Z coordinate system. Structural member 100 includes a monocrystalline silicon structure 101 which has a frame portion 111, spring elements **112*a*–112*d* and platform portion 113. Spring elements 112*a*–112*d* extend from frame 111 to platform 113 in a serpentine pattern. Spring elements 112*a*–112*d* provide compliance along the Z-axis. Thus, when frame 111 is fixed and a force is applied to platform 113 along the Z-axis, platform 113 moves along the Z-axis at the ends of springs 112*a*–112*d***.

In a particular embodiment, silicon structure 101 has a length, $L_X$, along the X-axis of approximately 2.5 mm, and a length, $L_Y$, along the Y-axis of approximately 2 mm. In this embodiment, structure 101 has a height, $L_Z$, along the Z-axis of approximately 30 μm. Springs **112*a*–112*d* each have a width, $W_S$, of approximately 80 μm, and an effective length, $L_S$, of approximately 3.5 mm. Frame 111 has a width, $W_F$, of approximately 0.6 mm. Platform 113** has a length, $L_{PX}$, along the X-axis of approximately 1.8 mm, and a length, $L_{PY}$ along the Y-axis of approximately 1.2 mm. These dimensions are illustrative and not limiting. Other dimensions are used in other embodiments of the invention.

Pole pieces 102 and 103 are located on the underside of platform 113. Pole tips 104–107 are located at the ends of pole pieces 102–103 as illustrated. As described in more detail below, pole pieces 102 and 103 and pole tips 104–107 are used to form a magnetic circuit which is controlled to apply an actuating force to platform 113 along the Z-axis. In one embodiment, pole pieces 102 and 103 and pole tips 104–107 are formed from a ferromagnetic material such as permalloy. In another embodiment, pole pieces 102 and 103 and pole tips 104–107 are formed from a permanent magnetic material, such as cobalt-nickel alloy. In one embodiment, pole pieces 102 and 103 have a thickness along the Z-axis of approximately 25 μm, and pole tips 102 and 103 have a thickness along the Z-axis of approximately 10 μm. As described in more detail below, pole tips 104–107 are positioned on platform 113 such that these pole tips will positioned over coils which are located on a lower structural member.

Relay contact bridge element 108 is located between pole pieces 102 and 103. Bridge element 108 includes first layer 115, second layer 116 and third layer 117. First layer 115 has a thickness along the Z-axis which is equal to the thicknesses of pole pieces 102 and 103 along the Z-axis. First layer 115 and pole pieces 102 and 103 are typically fabricated simultaneously using the same material. Thus, in the described embodiment, first layer 115 is permalloy having a thickness of approximately 25 μm.

Similarly, second layer 116 has a thickness along the Z-axis which is equal to the thicknesses of pole tips 104–107. Second layer 116 and pole tips 104–107 are typically fabricated simultaneously using the same material. Thus, in the described embodiment, second layer 116 is permalloy having a thickness of approximately 10 μm.

Third layer 117 is a non-magnetic, electrically conductive material which covers the lower surface of layer 116. In a preferred embodiment, third layer 117 is a layer of electroplated, evaporated or sputtered gold (or platinum or some other metal) having a thickness of approximately 2 μm. As described in more detail below, third layer 117 is used to bridge a gap between two other relay contact elements, thereby completing an electrical circuit. Because third layer 117 is a non-magnetic, electrically conductive material, third layer 117 advantageously conducts current without introducing a skin effect which can cause signal attenuation at high frequency.

By forming third layer 117 at the bottom of second layer 116, third layer 117 is necessarily located at the lowest point along the Z-axis of any element of upper structural member 100. As will become apparent in view of the further description below, this helps to assure that third layer 117 makes good electrical contact with relay contact pads of an underlying structural member.

A pair of registration rails 121–122 run around the perimeter of the underside of frame 111. Rails 121 and 122 include rails 121*a*–121*b* and rails 122*a*–122*b* as illustrated in FIG. 2. A trough 123 is formed between rails 121 and 122. Rails 121*a* and 122*a* have a thickness along the Z-axis which is equal to the thickness of pole pieces 102 and 103 along the Z-axis, and similarly, rails 121*b* and 122*b* have a thickness equal to the thickness of pole pieces 104 and 106. Rails 121–122, pole pieces 102–103 and pole tips 104, 106 are typically fabricated simultaneously using the same material. Thus, in the described embodiment, rails 121*a* and 122*a* are permalloy having a thickness of approximately 25 μm, and rails 121*b* and 122*b* are permalloy having a thickness of 10 μm. As described in more detail below, rails 121 and 122 are used to hold an adhesive which connects upper structural member 100 to a lower structural member.

Figure 4:
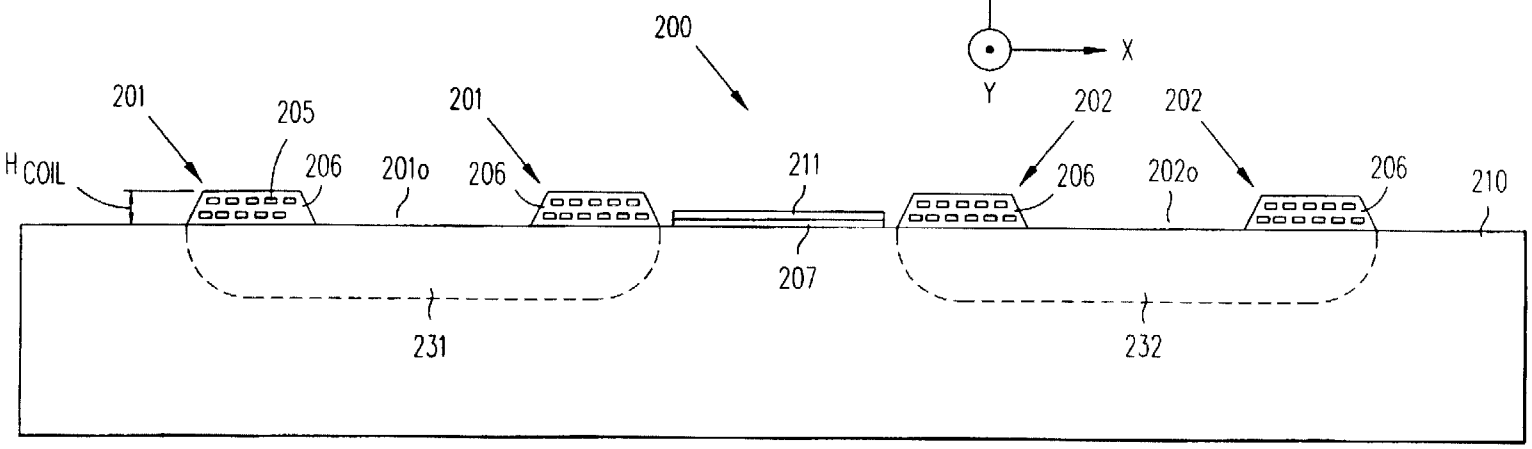
FIG. 4 is a cross sectional view of the lower structural member of FIG. 3 along section line 4—4 of FIG. 3.
Figure 3:
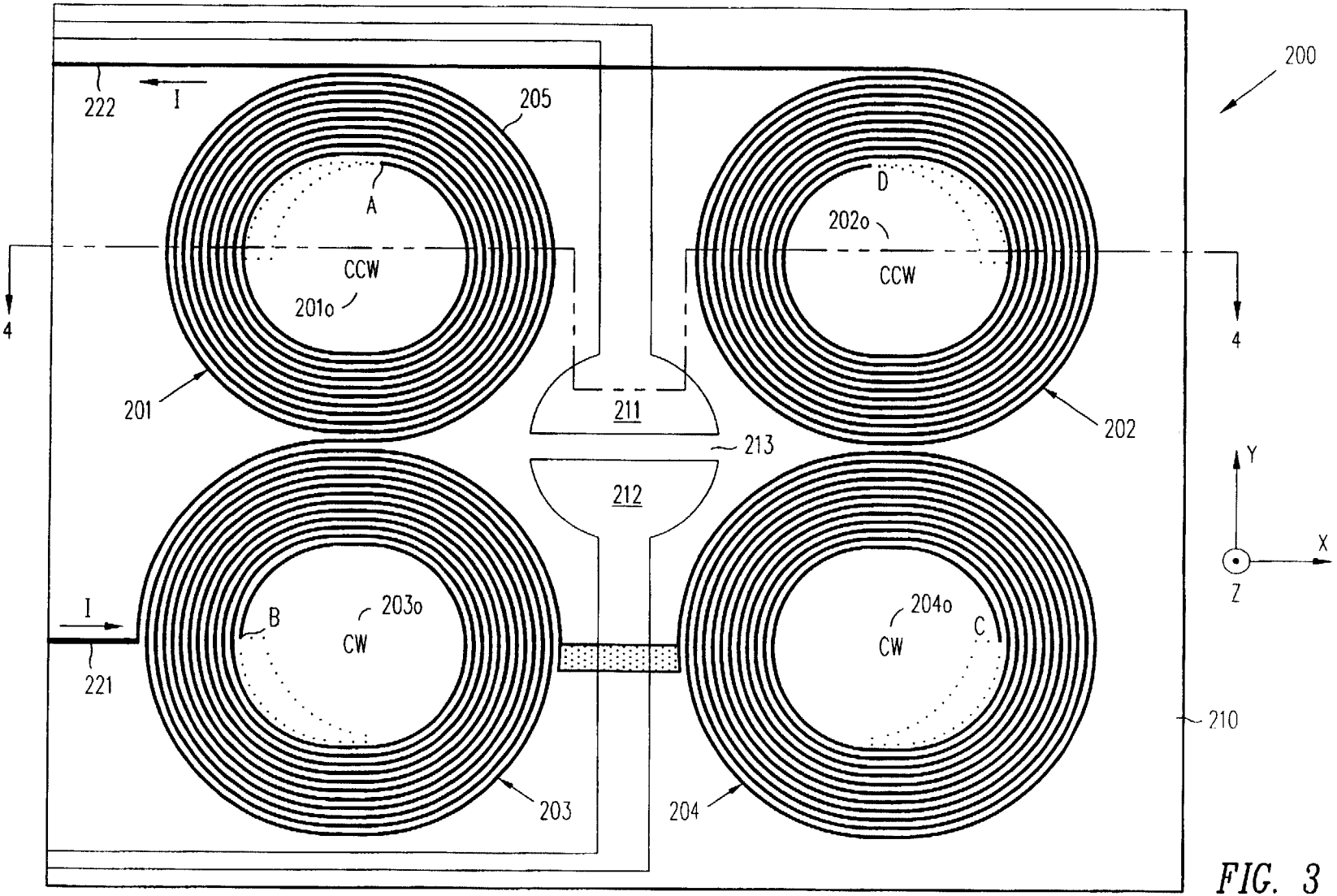
FIG. 3 is a top view of a lower structural member in accordance with one embodiment of the invention.

FIG. 3 is a top view of lower structural member 200. FIG. 4 is a cross sectional view of lower structural member 200 along section line 4—4 of FIG. 3. FIGS. 3 and 4 use the same X-Y-Z coordinate system as FIGS. 1 and 2. As described in more detail below, upper structural member 100 is connected to lower structural member 200 to form a micro-relay. As used herein, the terms "micro-relay" and "micro-switch" are interchangeable.

Lower structural member 200 includes four coils 201–204 located on substrate 210. In one embodiment, coils 201–204 are fabricated in accordance with techniques known to those skilled in the art. Each of coils 201–204 includes a plurality of electrically conductive windings, (e.g., winding 205) which are electrically isolated from adjacent windings by an insulating material 206. In a particular embodiment, the windings of coils 201–204 are made of copper. Openings 201*o*–204*o* are located at the respective central portions of coils 201–204. In one embodiment, openings 201*o*–204*o* each have diameters of approximately 400 μm, coils 201–204 have outer diameters of approximately 850 μm, and coils 201–204 have a height $H_{COIL}$ along the Z-axis of approximately 10 μm.

End A of coil 201 is connected to end B of coil 203. Similarly, end C of coil 204 is connected to end D of coil 202. These connections are not shown for purposes of clarity. As a result of the previously described connections, a positive current flowing into lead 221 (and out of lead 222) causes current to flow in a clockwise direction in coils 203 and 204, and in a counterclockwise direction in coils 201 and 202.

In the illustrated embodiment, substrate 210 is a ferromagnetic material such as ferrite, having a thickness along the Z-axis of approximately 600 μm. Current flowing in coils 201–204 results in the generation of a magnetomotive force (MMF) which magnetizes distinct pathways within substrate 210. A first pathway 231 extends between openings 201*o* and 203*o*, and a second pathway 232 extends between openings 202*o* and 204*o* (FIG. 4). First and second pathways 231 and 232 define respective first and second electromagnets which are energized by the applied current. The first electromagnet, which is defined by first pathway 231 and coils 201 and 203, has a pole with a first polarity (e.g., north) at opening 201*o* and a pole with a second polarity (e.g. south) at opening 203*o*. Similarly, the second electromagnet, which is defined by second pathway 232 and coils 202 and 204, has a pole with a first polarity (e.g., north) at opening 202*o* and a pole with a second polarity (e.g., south) at opening 204*o*.

In a different embodiment, the substrate material can be a non-ferromagnetic material, such as silicon. In this case, the pathways 231 and 232 are formed by etching trenches into the silicon (using wet chemical or dry plasma), filling the trenches with a ferromagnetic material (e.g., permalloy) and polishing the upper surface of the resulting structure.

Electrically conductive relay contact elements 211 and 212 are located over substrate 210 between coils 201–204. Relay contact elements 211 and 212 are formed on an insulating layer 207, such that relay contact elements 211 and 212 are electrically isolated from substrate 210. A gap 213 exists between relay contact elements 211 and 212, such that these elements 211 and 212 are electrically isolated from each other. In a particular embodiment, insulating layer 207 is sputtered aluminum oxide, and has a height along the Z-axis of approximately 5000 Å. Relay contact elements 211 and 212, which are typically gold, have a height along the Z-axis of approximately 2 μm.

Figure 5A:
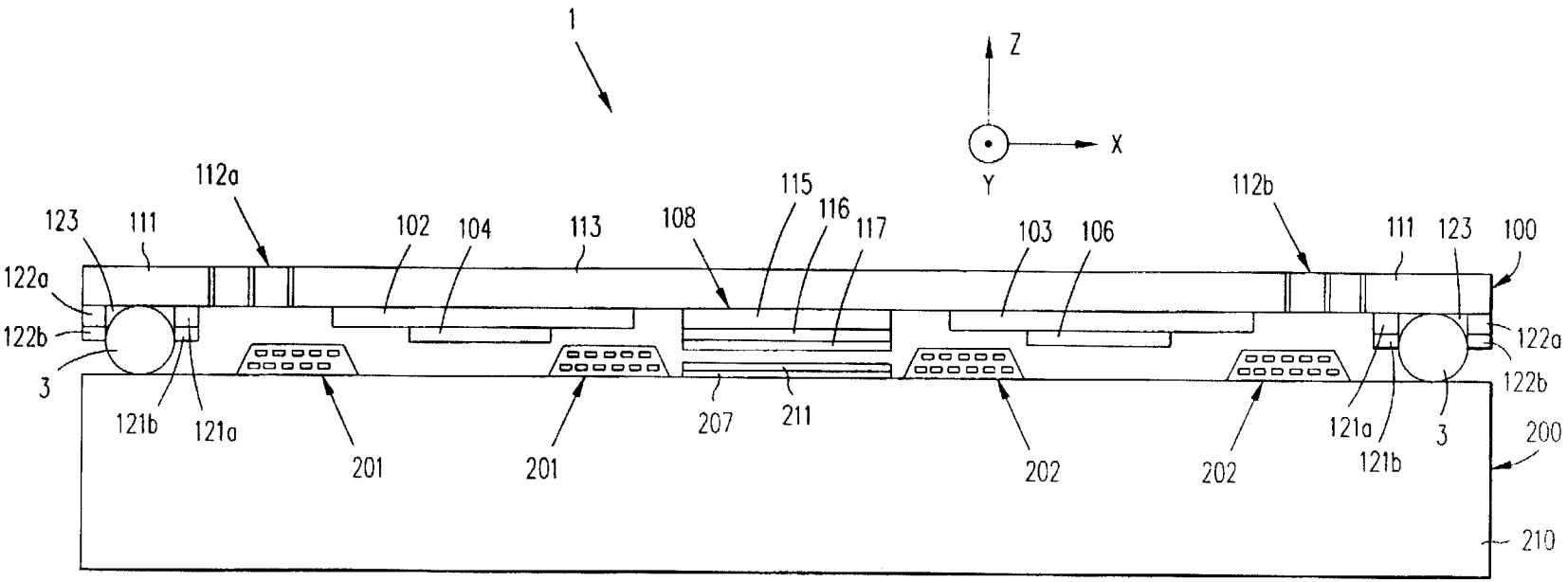
FIG. 5*a* is a cross sectional view illustrating a micro-relay which is formed by connecting the upper structural member of FIGS. 1 and 2 to the lower structural member of FIGS. 3 and 4.

FIG. 5*a* is a cross sectional view illustrating micro-relay 1 which is formed by connecting upper structural member 100 and lower structural member 200. In the illustrated embodiment, an adhesive which contains glass spacer beads 3 is located in trough 123 between rails 121 and 122. The diameter of glass beads 3 is selected to provide the desired spacing between structural members 100 and 200. In the present embodiment, beads 3 have a diameter of approximately 43 μm. Although not illustrated in FIG. 5*a* (as FIG. 5*a* is not to scale), trough 123 must be at least as wide as the diameter of beads 3. Additionally, the height of rails 121 and 122 along the Z-axis should be greater than the radius of beads 3, and less than the diameter of beads 3. Furthermore, the trough 123 for containing the adhesive can have other shapes. For example, straight channels or circular reservoirs with radial satellite channels can be used to retain the adhesive.

Other methods of attaching structural members 100 and 200 can be used in other embodiments. For example, glass rods can be used instead of glass beads 3. In another example, rails 121–122 are given a thickness equal to the desired spacing between the structural members 100 and 200. Rails 121–122 are then fixed to substrate 210 using an appropriate grade of adhesive. Other suitable methods and structures for connecting structural members 100 and 200 can also be used. For example, a very shallow cavity (e.g., having a depth of 8 μm) can be etched into the bottom surface of the silicon platform 113. The pole pieces 102 and 103, pole tips 104–107 and contact element 108 are then electro-plated into this cavity. Since the rails 121 and 122 have the same thickness as the pole pieces 102–103 and pole tips 104–107, after assembly, the gap between contact elements 117 and 211 will be equal to the difference between the cavity depth (e.g., 8 μm) and the combined thickness of contact elements 117 and 211 (e.g., 2 μm+2 μm).

Micro-relay 1 operates as follows. When no current is applied to coils 201–204, micro-relay 1 remains in the position illustrated in FIG. 5*a*. That is, bridge element 108 is separated from contact elements 211 and 212. As a result, no current flows between contact elements 211 and 212.

Figure 5B:
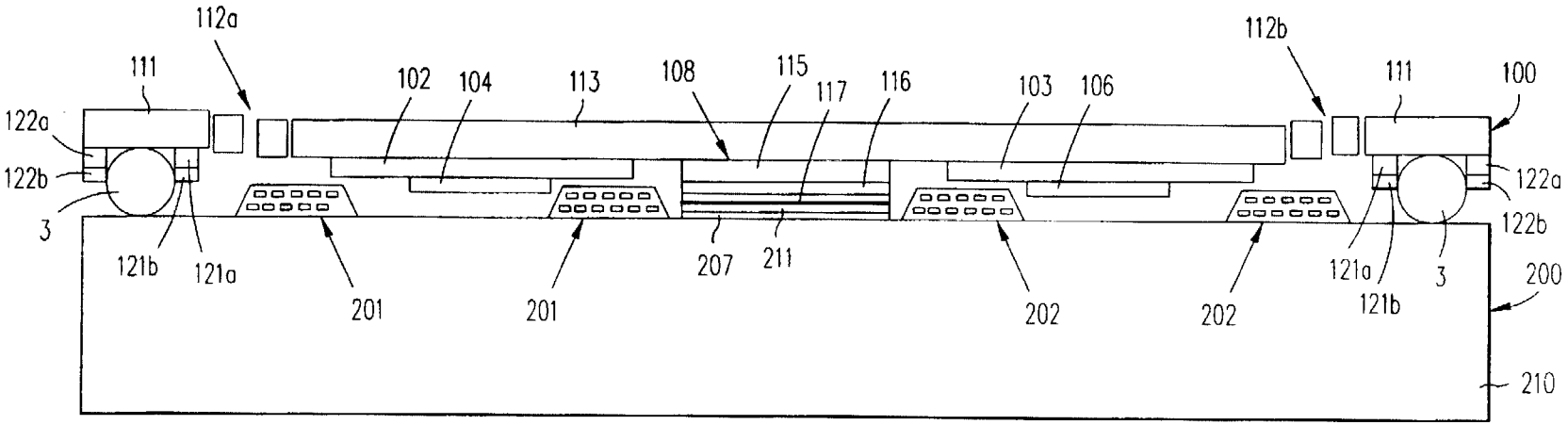
FIG. 5*b* is a cross sectional view illustrating the micro-relay of FIG. 5*a* in a closed position.

When a current is applied to coils 201–204, pathways 231 and 232 of substrate 210 are magnetically excited. Four contact pads (not shown) are coupled to lead 221, lead 222, contact pad 211 and contact pad 212 (FIG. 3) of micro-relay 1, thereby providing electrical connections to micro-relay 1. As previously described, a first electromagnet is formed between coils 201 and 203 and a second electromagnet is formed between coils 202 and 204. These electromagnets generate electromagnetic forces which tend to attract pole pieces 102 and 103 and pole tips 104–107. Pole tips 104–107 extend into respective openings 201*o*–204*o*, thereby enhancing the generated electromagnetic forces. The electromagnetic forces tend to pull platform 113 down along the negative Z-axis. Springs 112*a*–112*d* provide compliance which allows platform 113 to move toward lower structural member 200. Platform 113 is pulled down until bridge element 109 touches both of contact elements 211 and 212, thereby providing an electrical path between elements 211 and 212 across gap 213. At this point, micro-relay 1 is closed and current is free to flow between elements 211 and 212. FIG. 5*b* illustrates micro-relay 1 in the closed position. Note that springs 112*a*–112*d* and platform 113 are pulled downward along the Z-axis, out of the plane of frame 111. When current is eliminated from coils 201–204, monocrystalline structure 101 returns to the open position illustrated in FIG. 5*a*.

The electromagnetic force which actuates micro-relay 1 has a magnitude of approximately 1.5 mN. This is much greater than the forces generated by conventional electrostatic means. As a result, monocrystalline structure 101 can be made of monocrystalline silicon, having a sufficient thickness to create a stiff structural member. The stiff mechanical structure provides for fast switching times and prevents arcing during transitions between the closed and open states of micro-relay 1.

The single crystal structure of monocrystalline structure 101 provides mechanical advantages, such as superior stiffness, durability, fatigue and deformation characteristics. The processing of the single crystal monocrystalline structure results in a relatively defect-free structure. The size effect of single crystal material provides that the defect density decreases and the strength of the material increases as the size of the structure decreases. As a result, since there is no internal material defect, failure of structure 101 will only occur if a surface crack or flaw exists. Such a defect is relatively easy to detect and avoid, thereby making inspection and improvement of the silicon mechanical structures relatively easy and reliable.

The magnetic paths within micro-relay 1 are separate from the electrical path of micro-relay 1. This allows the electrical path which to be formed using a low resistance, non-magnetic electrically conductive material, such as gold. As a result, high frequency signals can be passed by micro-relay 1, without signal attenuation at high frequency due to skin effect.

The fabrication of structural members 100 and 200 will now be described in detail. In accordance with one embodiment of the invention, upper structural member 100 is fabricated as follows. Silicon structure 101 is formed from a monocrystalline silicon wafer having a <100> crystalline structure. In one embodiment, the silicon wafer is bonded to the bottom substrate after deposition of the pole pieces and bridge contact, and polished from the top side until the wafer has the desired thickness of structure 101. In the illustrated embodiment, monocrystalline structure 101 has a thickness in the range of 5 to 100 μm. Other monocrystalline semiconductor materials can also be used to form structure 101.

Figure 6A:
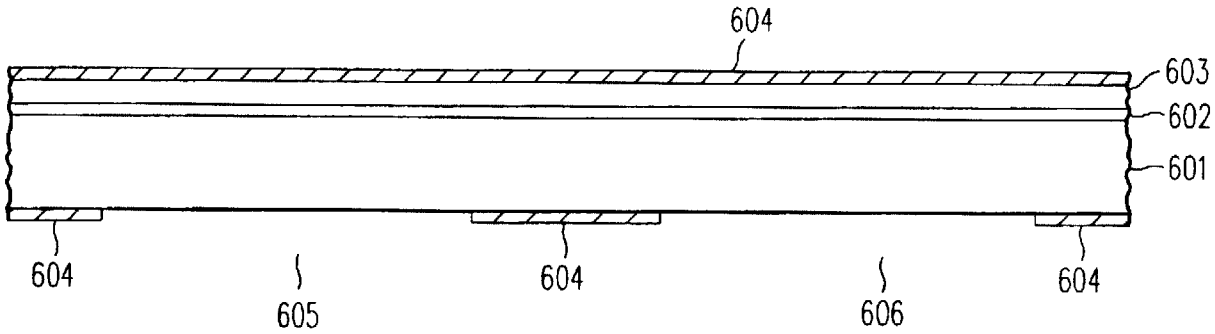
FIGS. 6*a*–6*c* are cross sectional view illustrating the fabrication of portions of a pair of upper structural members.
Figure 6B:
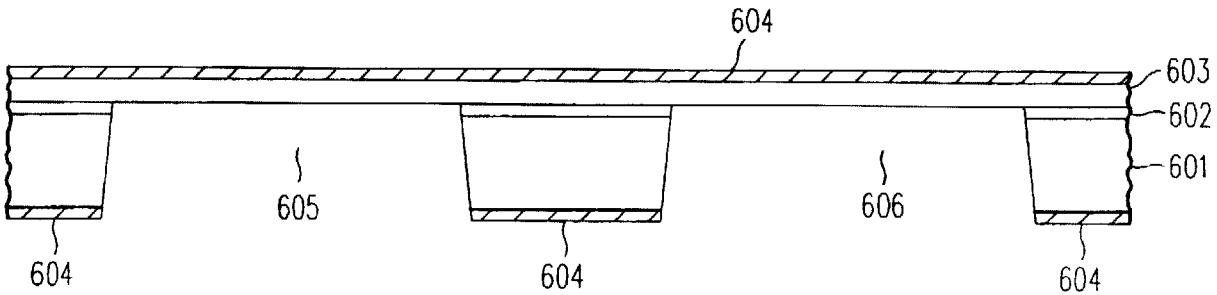
Figure 6C:
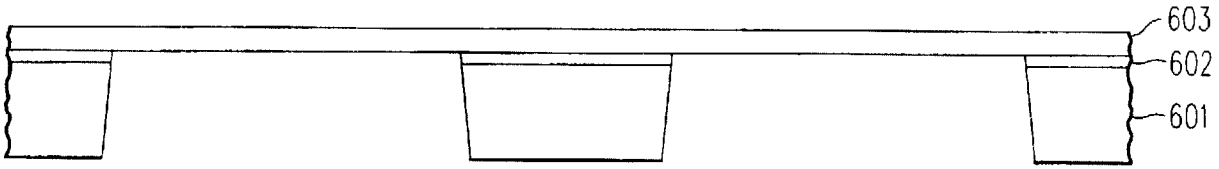

Another method for forming silicon structure 101 is illustrated in FIGS. 6*a*–6*c*. In this embodiment, an upper surface of silicon wafer 601 is polished. As shown in FIG. 6*a*, a boron doped monocrystalline silicon layer 602 having a thickness of 2 to 3 microns is epitaxially grown on this polished upper surface using conventional silicon processing techniques. A lightly doped monocrystalline silicon layer 603 having the desired monocrystalline structure thickness (e.g., 2 to 100 μm) is then epitaxially grown on the boron doped silicon layer 602 using conventional processing techniques. The resulting structure is thermally oxidized such than a thin layer of oxide 604 (about 1 μm) is grown on the external wafer surfaces. Oxide 604 on the bottom surface of wafer 601 is patterned with photoresist (not shown) such that there are a number of rectangular openings. The oxide within each of these openings is removed such that there are a number of openings 605–606 formed in oxide layer 604 at the bottom surface of silicon substrate 601.

As shown in FIG. 6*b*, silicon wafer 601 is etched from its back side using an etchant which attacks the silicon through openings 605–606. The etchant has a characteristic such that the original undoped silicon wafer 601 is etched relatively quickly and the boron doped silicon layer 602 is etched relatively slowly. The back side etch continues until only the boron doped layer 602 and the lightly doped epitaxial silicon layer 603 remain. The exposed boron-doped silicon layer 602 is removed using a different etchant which etches only boron-doped silicon. As a result, only lightly doped silicon layer 603 remains in the locations defined by openings 605–606. Oxide 604 is removed, leaving the structure of FIG. 6*c*. The structure of FIG. 6*c* is inverted and used to form a plurality of upper structural members. In general, layer 603 is used to form the spring and platform portions of the upper structural members, while layers 601 and 602 form the frame portions of the upper structural members. In one embodiment, the structure of FIG. 6*c* is used to form the upper structural members of a pair of adjacent integrated micro-relays. Alternatively, the structure of FIG. 6 can be diced and used to form two separate upper structural members.

Besides using a boron-doped layer as the etch stop, there are many other techniques which can be used to control the thickness of monocrystalline structure 101. For example, monocrystalline structure 101 can be lightly-doped and a potential difference can be applied across the monocrystalline structure and the silicon substrate to form a P-N junction which acts as a electrochemical etch stop. Furthermore, the back surface of the substrate can be polished and etched at low temperature until a monocrystalline structure of a desired thickness remains.

Figure 7A:
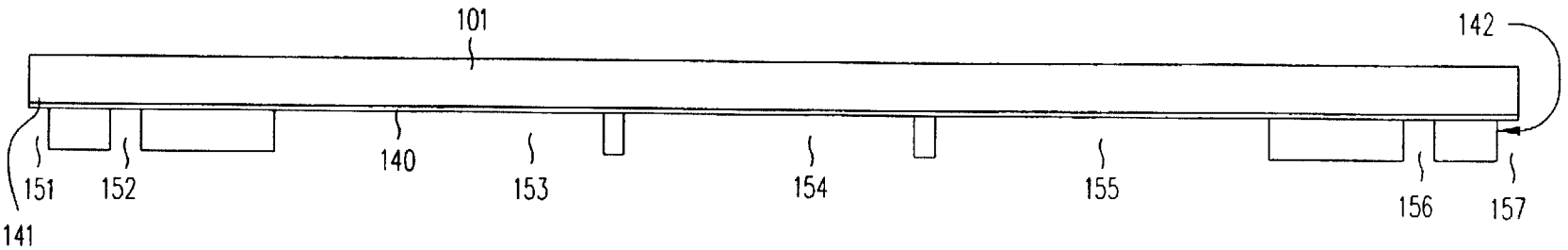
FIGS. 7*a*–7*f* are cross sectional views illustrating the fabrication of the upper structural member of FIGS. 1 and 2 in accordance with one embodiment of the invention.

The formation of upper structural member 100 from monocrystalline structure 101 is illustrated in FIGS. 7*a*–7*f*, which are views along section line 2—2 of FIG. 1. As illustrated in FIG. 7*a*, a metal seed layer 140 is sputtered (or evaporated) over lower surface 141 of monocrystalline structure 101 to a thickness of approximately 1000 Å. Seed layer 140 can be, for example, titanium/copper, chrome/copper or permalloy). A photoresist layer 142 is spun over seed layer 140. Photoresist layer 142 is exposed through a reticle (not shown) and developed to form openings 151–157.

Figure 7B:
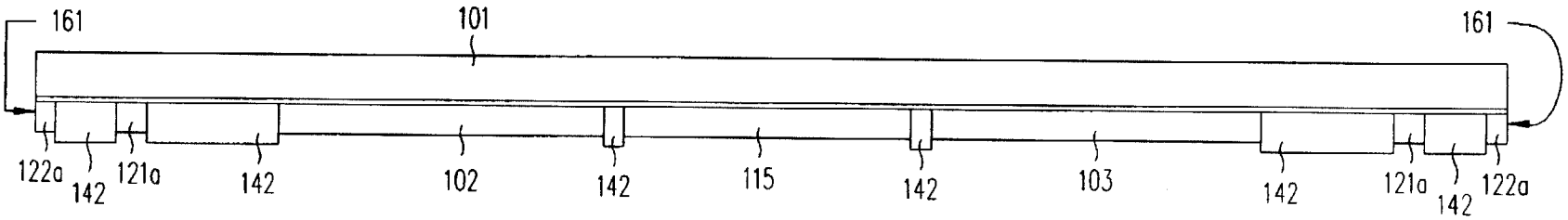
Figure 7C:
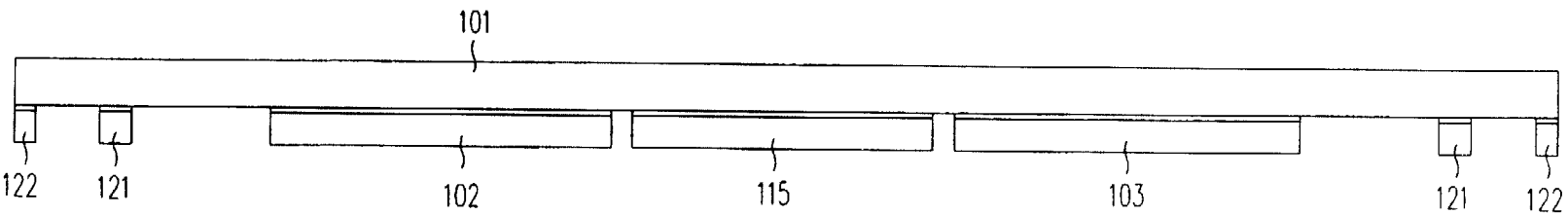

As shown in FIG. 7*b*, a first layer 161 of ferromagnetic material, such as permalloy, is electroplated onto seed layer 140 through openings 151–157 using conventional electroplating steps. First permalloy layer 161 forms rails 121*a* and 122*a*, pole pieces 102 and 103 and first layer 115. In the illustrated embodiment, first permalloy layer 161 has a thickness of 25 μm. Photoresist layer 142 and the exposed portions of seed layer 140 are stripped as shown in FIG. 7*c*.

Figure 7D:
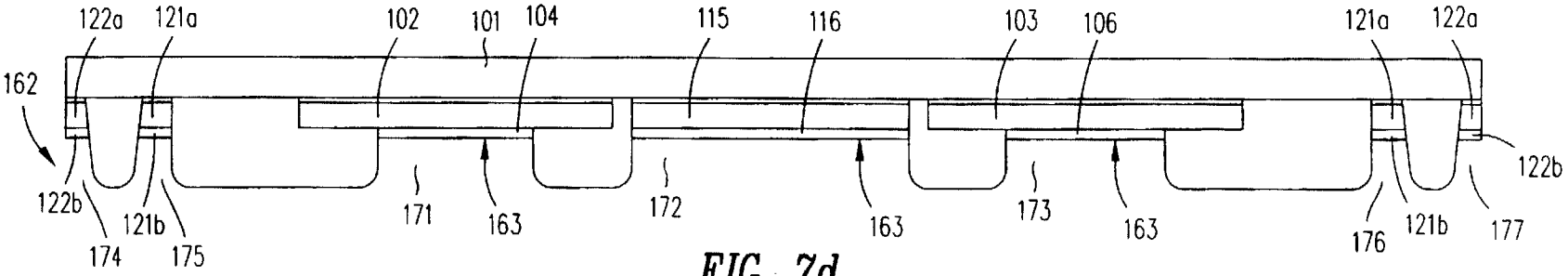

A second photoresist layer 162 is formed over the resulting structure as illustrated in FIG. 7*d*. Second photoresist layer 162 is patterned, in the same manner previously described in connection with photoresist layer 142, to create openings 171–177. A second layer 163 of ferromagnetic material, such as permalloy, is electroplated onto the portions of the first permalloy layer 161 which are exposed by openings 171–177. Second permalloy layer 163 forms pole tips 104–107, second layer 116 and rail portions 121*b* and 122*b*. In the illustrated embodiment, the thickness of second permalloy layer 163 is approximately 10 μm.

In another variation, pole tips 104–107 are not formed. In this variation, the steps previously described for forming second permalloy layer 163 are omitted.

Figure 7E:
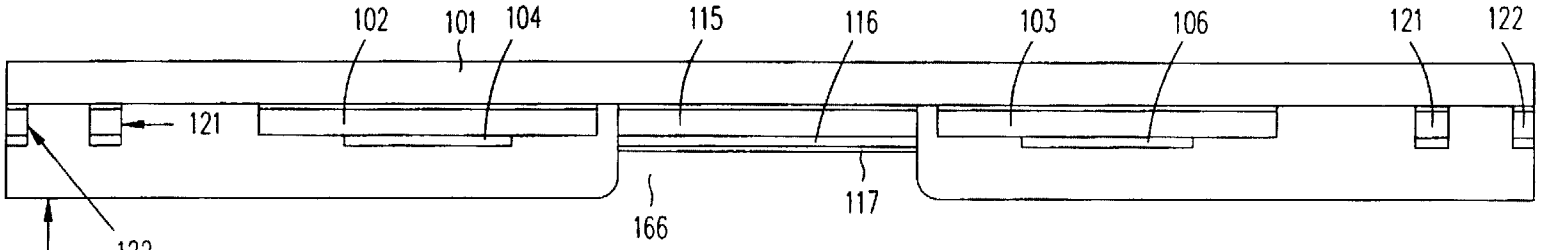

Second photoresist layer 162 is then stripped and a third photoresist layer 165 is formed over the resulting structure as shown in FIG. 7*e*. A single opening 166 is formed through third photoresist layer 165. An electrically conductive metal layer 117 is electroplated on second layer 116 through opening 166. In one embodiment, metal layer 117 is gold having a thickness of approximately 2 μm. Third photoresist layer 165 is then stripped. In another embodiment, the original seed layer 140 is not removed in between process steps and the photoresist layers 142, 162, 165 are also not removed until the very end. Then they are removed in one step to save processing costs.

Figure 7F:
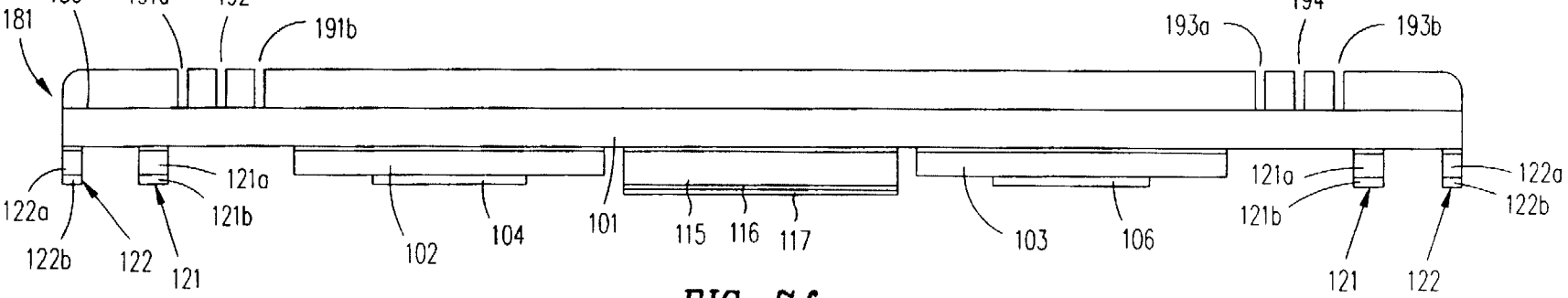

Fourth photoresist layer 181 is formed over lower surface 141 or upper surface 180 of the resulting structure. In FIG. 7*f*, photoresist layer 181 is shown over upper surface 180 of monocrystalline structure 101. Openings 191*a*–191*b*, 192, 193*a*–193*b* and 194 are formed in photoresist layer 181. These openings define spring elements 112*a* and 112*b*. An anisotropic plasma etch of monocrystalline structure 101 is performed through openings 191*a*–191*b*, 192, 193*a*–193*b* and 194, thereby forming frame 111, spring elements 112*a*–112*d*, and platform 113 as illustrated in FIGS. 1 and 2. Although spring elements 112*a*–112*d* are shown as having a specific serpentine design in FIG. 1, other spring designs are contemplated and considered within the scope of the invention. In a particular embodiment, spring elements 112*a*–112*d* are eliminated, thereby providing a continuous monocrystalline structure which is flexed along the Z-axis. Such a continuous monocrystalline structure has a relatively high spring rate. In the previously described steps, instead of photoresist, other masking material can be used including oxide, chrome, aluminum and nickel.

Figure 8A:
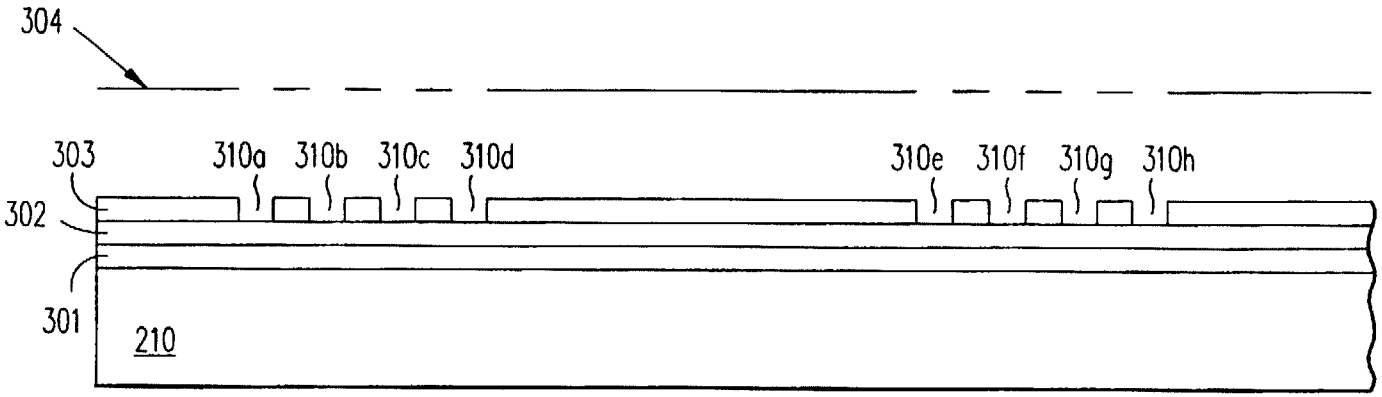
FIGS. 8*a*–8*h* are cross sectional views illustrating the fabrication of the lower structural member of FIGS. 3 and 4 in accordance with one embodiment of the invention.

Lower structural element 200 is fabricated as illustrated in FIGS. 8*a*–8*g*. FIGS. 8*a*–8*g* illustrate the fabrication of coil 201 along section line 4—4 of FIG. 3. Substrate 210 is either ferromagnetic material having a polished upper surface or a non-ferromagnetic material with ferromagnetic material filled in cavities. In one embodiment, substrate 210 is a solid ferrite wafer having a thickness of approximately 600 μm. As illustrated in FIG. 8*a*, an insulating layer 301 is deposited over the upper surface of substrate 210. A titanium/copper (or other metals) seed layer 302 is deposited over insulating layer 301 to a thickness of approximately 1000 Å. A layer of photoresist 303 is spun over seed layer 302. In the illustrated embodiment, photoresist layer 303 is made from a positive photoresist material. That is, exposed portions of photoresist layer 303 are removed when photoresist layer 303 is developed. Photoresist layer 303 is exposed through reticle 304 and developed. Openings 310*a*–310*h* are formed through photoresist layer 303 as a result. Openings 310*a*–310*h* define a first layer of windings of coil 201.

Figure 8B:
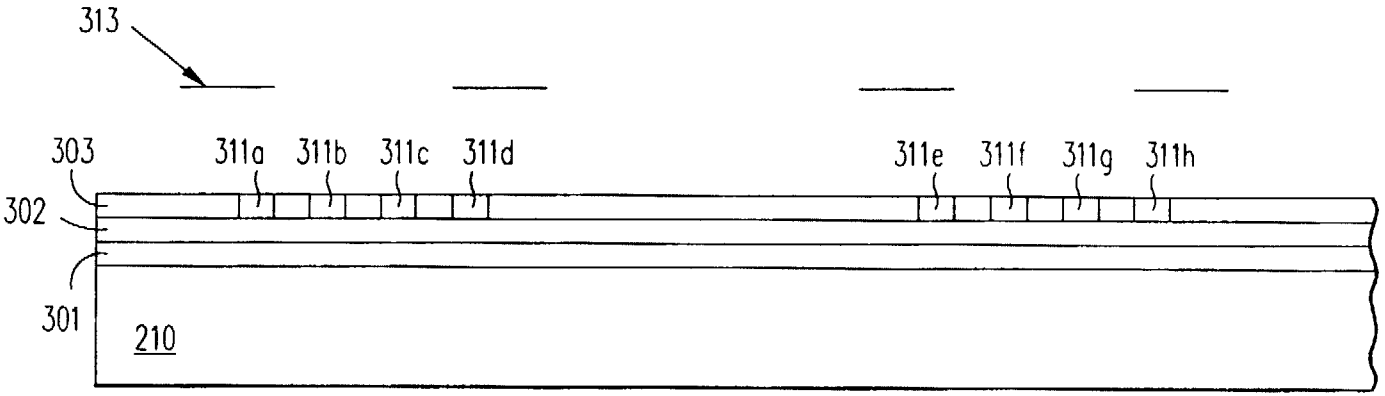
Figure 8C:
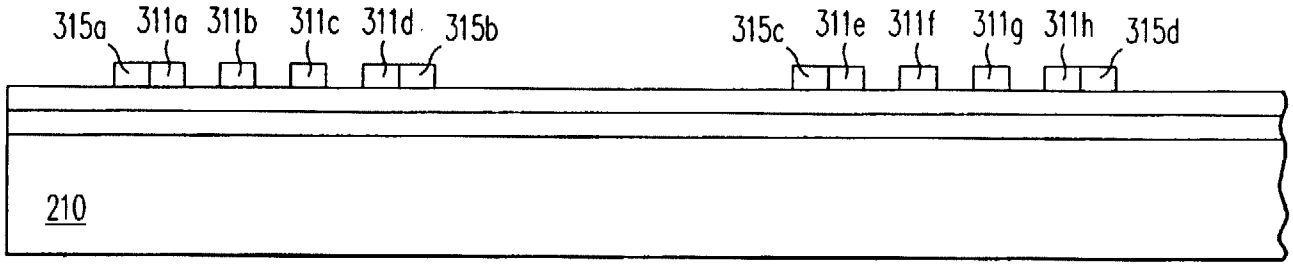

As shown in FIG. 8*b*, copper traces 311*a*–311*h* are electroplated through openings 310*a*–310*h* in photoresist layer 303. The resulting structure is exposed through reticle 313 and developed. Reticle 313 prevents the portions of photoresist layer 303 immediately adjacent to the innermost portions of copper traces 311*d* and 311*e*, and the outermost portions of copper traces 311*a* and 311*h* from being exposed. This is possible since the electroplating and all other related processes are done in a yellow-lighting environment. Thus, after photoresist layer 303 is developed, the unexposed photoresist portions 315*a*–315*d* remain as illustrated in FIG. 8*c*. The resulting structure is baked, thereby hardening photoresist spacers 315*a*–315*d*.

Figure 8D:
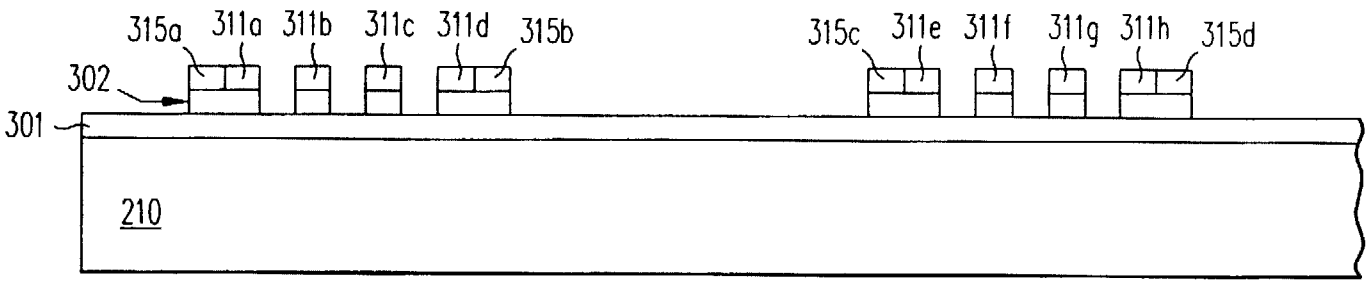

Turning now to FIG. 8*d*, seed layer 302 is removed, except at the places where traces 311*a*–311*h* or photoresist spacers 315*a*–315*d* overlie seed layer 302. Seed layer 302 is removed using a conventional technique such as ion-milling, sputter-etching or wet-chemical etching.

Figure 8E:
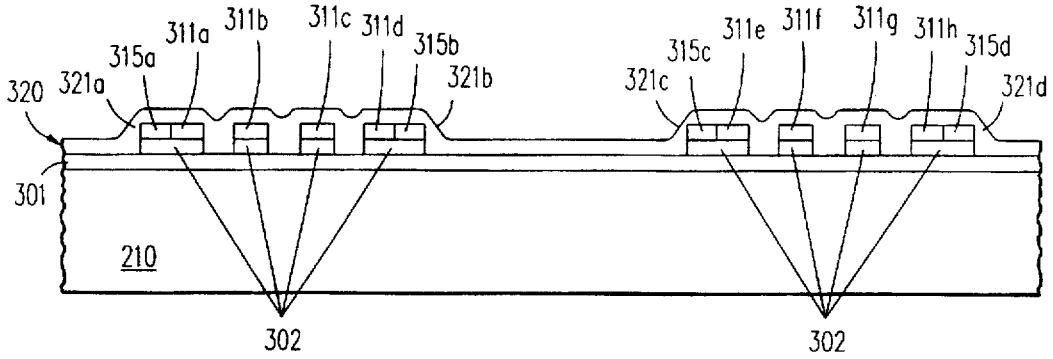

An insulating layer 320 of photoresist, polyimide, spin-on glass or PECVD oxide is deposited over the surface of the resulting structure as illustrated in FIG. 8*e* to a thickness of approximately 2 μm. Insulating layer 320 isolates traces 311*a*–311*h* from subsequently formed layers of traces. Contact openings (not shown) are formed through insulating layer 320 to allow selective interconnection of traces 311*a*–311*h* to an overlying layer of traces (not shown in FIG. 8*e*) to form a coil. Typically, insulating layer 320 is thinnest at points 321*a*–321*d*. However, the structure immediately adjacent to these thin points 321*a*–321*d* is the underlying photoresist spacers 315*a*–315*d*. Thus, even if insulating layer 320 does not provide complete coverage at points 321*a*–321*d*, coil 201 will still be functional (i.e., no shorts will exist between coil windings) because photoresist spacers 315*a*–315*d* do not carry current in coil 201.

Figure 8F:
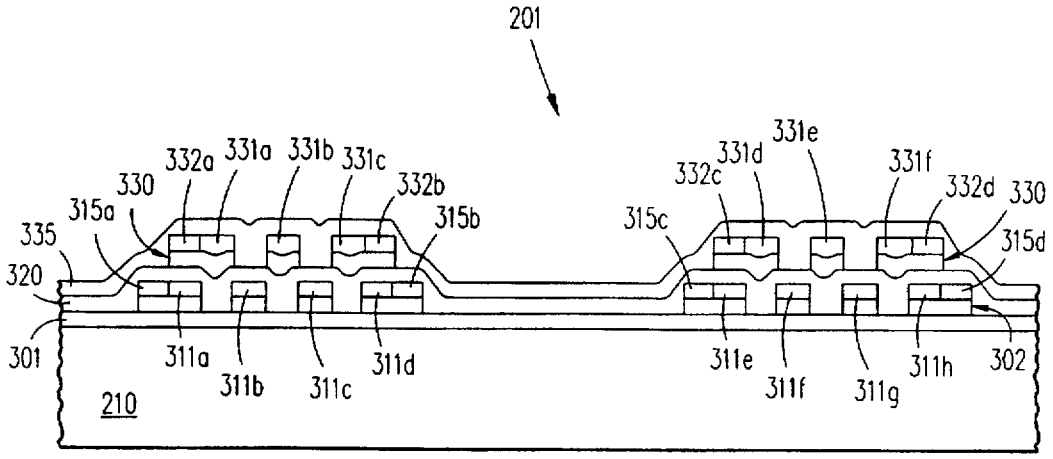

As illustrated in FIG. 8*f*, a second winding structure is formed over insulating layer 320 in the same manner that the first winding structure of FIGS. 8*a*–8*e* was formed on insulating layer 301. The second winding structure includes seed layer 330, copper traces 331*a*–331*h*, photoresist spacers 332*a*–332*d* and insulating layer 335. Again, photoresist spacers 332*a*–332*d* are located immediately adjacent to the thinnest portions of overlying insulating layer 335, thereby preventing electrical shorts within coil 201.

Figure 8G:
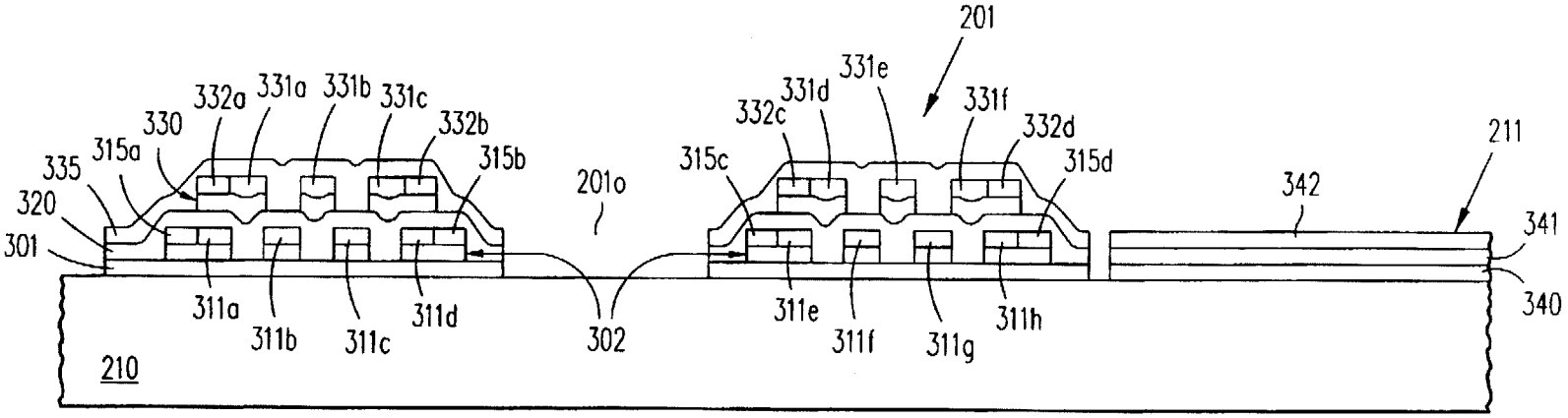

The portions of insulating layers 301, 320 and 335 which surround coil 201 are removed as illustrated in FIG. 8*g*. Relay contact element 211 is then formed by depositing an insulating layer 340 on substrate 210, sputtering a titanium/copper (or other metal) seed layer 341 over insulating layer 340, and electroplating gold layer 342 over seed layer 341. Seed layer 341 and gold layer 342 are given the pattern illustrated in FIG. 3.

Figure 8H:
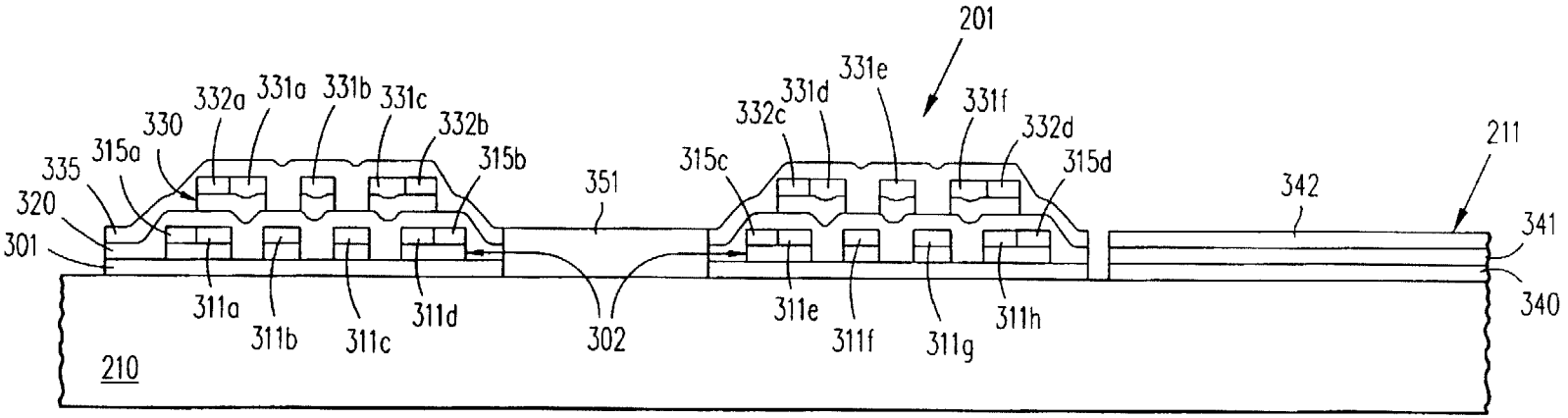

In a variation of this embodiment, a permalloy pole tip 351 can be fabricated in opening 201*o* of coil 201 (and in openings 202*o*–204*o* of the other coils 202–204, not shown) as illustrated in FIG. 8*h*. In this variation, the pole tips 104–107 may or may not be included in upper structural member 100.

Figure 9A:
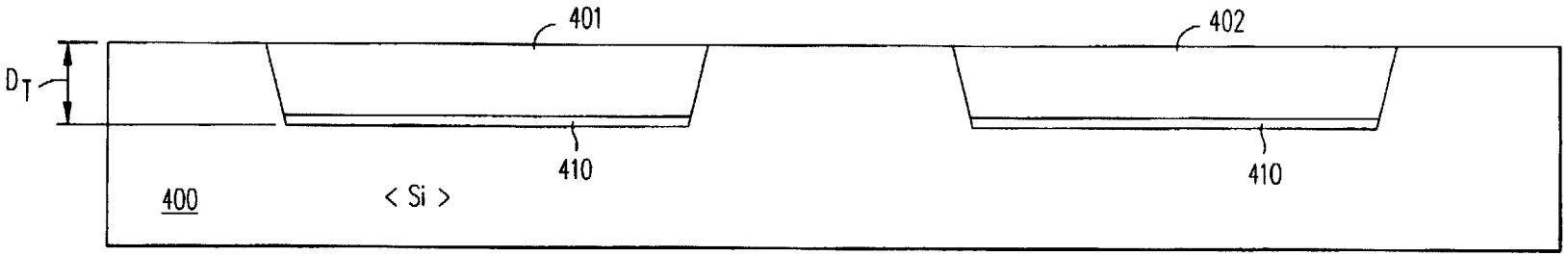
FIGS. 9*a* and 9*b* are cross sectional and top views, respectively, of a portion of a lower structural member in accordance with an alternative embodiment.
Figure 9B:
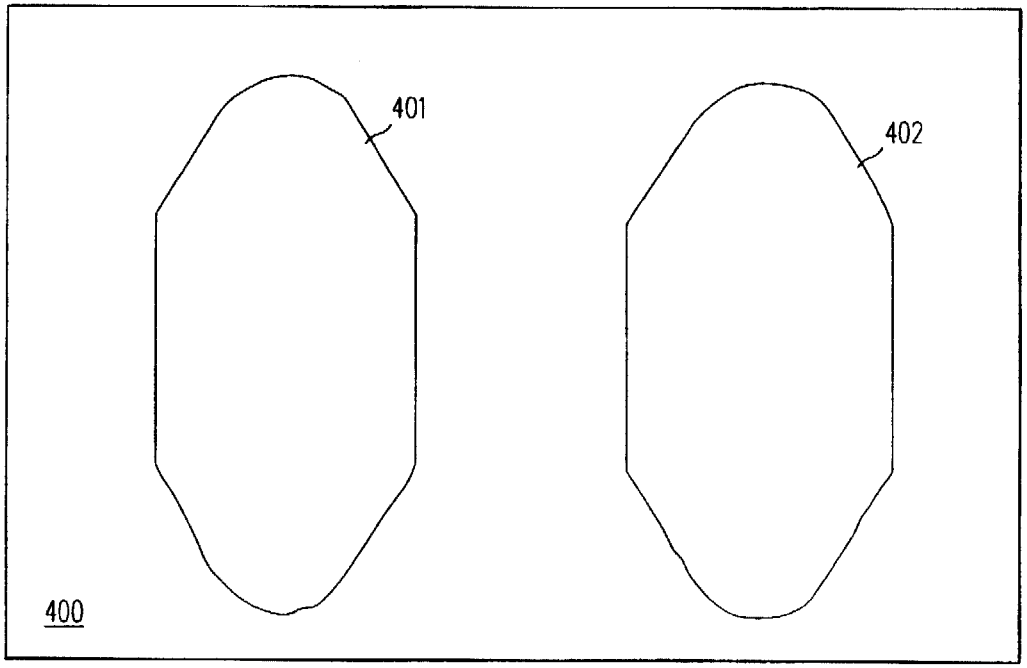

FIGS. 9*a* and 9*b* illustrate cross sectional and top views, respectively, of a portion of lower structural member 200 in accordance with an alternative embodiment. In this embodiment, lower structural member 200 is formed from a monocrystalline silicon substrate 400. As illustrated in FIG. 9*a*, a pair of trenches is etched into the upper surface of silicon substrate 400. A seed layer 410 is sputtered on the bottom of trenches, and ferromagnetic pole pieces 401–402 are electroplated on seed layer 410. In one embodiment, pole pieces 401–402 have a depth D in the range of 20 to 40 μm. As illustrated in FIG. 9*b*, pole pieces 401 and 402 extend along the magnetic pathways between coils 201–203 and 202–204. Coils 201–204 are formed over the resulting structure in the same manner previously described in connection with FIGS. 8*a*–8*h*.

Besides the low-cost of the silicon substrate, this embodiment provides the further advantage of allowing other semiconductor devices (e.g., transistors, diodes, resistors, capacitors) to be fabricated in silicon substrate 400. These semiconductor devices can form circuitry which is used to control micro-relay 1. In addition to integrating microelectronic devices into substrate 400, these devices can be fabricated separately and later bonded to substrate 400 (which can be silicon or not), in areas adjacent to upper structural member 100.

In an alternative embodiment of the invention, upper pole pieces 102 and 103 are replaced with a permanent magnetic material such as cobalt-nickel alloy. In this embodiment, a current through coils 201–104 having a first polarity causes the permanent magnets to be attracted to coils 201–204. As a result, monocrystalline structure 101 flexes to bring the permanent magnets closer to the lower structural member 200. Once brought into close proximity with structural member 200, the strength of the permanent magnets is sufficient to hold the relay in a closed position. To open relay 1, a current having a second polarity, opposite the first polarity, is provided to coils 201–204. This current generates a force which tends to repel the permanent magnets from lower structural member 200. The generated force is sufficient to push monocrystalline structure 101 back to an open position. When relay 1 is in an open position, the forces generated by the permanent magnets, by themselves, are insufficient to cause micro-relay 1 to close, thus providing the relay with latching capabilities.

Figure 10:
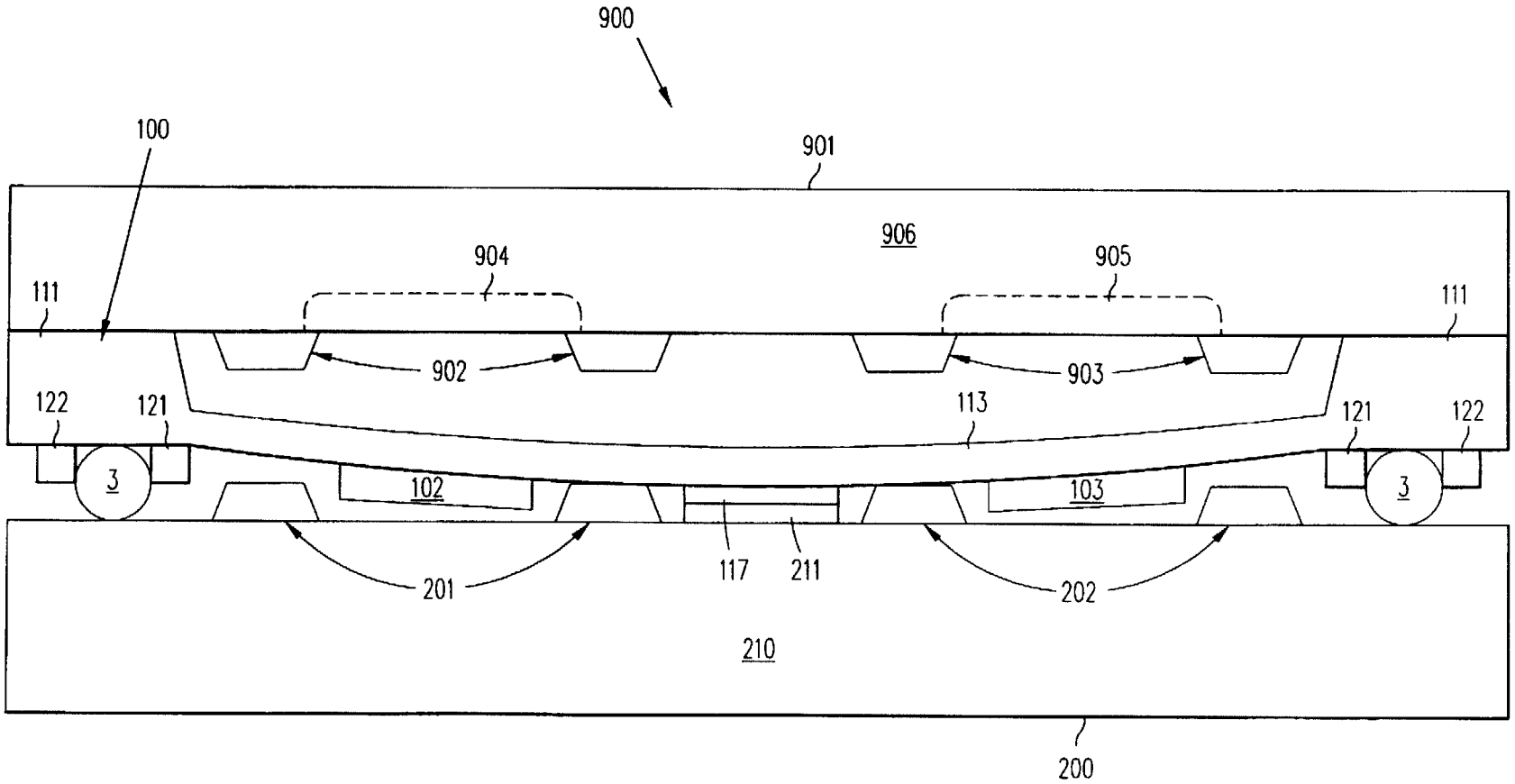
FIG. 10 is a cross sectional view of a latching micro-relay in accordance with an embodiment of the invention.

FIG. 10 illustrates another micro-relay 900 with latching capabilities. Micro-relay 900 includes upper structural member 100, lower structural member 200, and second upper structural member 901. Upper structural member 100 and lower structural member 200 of micro-relay 900 are substantially identical to upper structural member 100 and lower structural member 200 of micro-relay 1 (FIG. 5*a*). Thus, similar elements are labeled with similar reference numbers. However, upper structural member 100 of micro-relay 900 has a thinner monocrystalline silicon platform 113 (e.g., 5 μm) than platform 113 of micro-relay 1. In addition, upper structural member 100 of micro-relay 900 does not include any spring elements.

When a current is applied to coils 201–202 of micro-relay 900, platform 113 buckles and latches into contact with lower structural member 200 as shown in FIG. 10. Platform 113 remains latched even after current is no longer applied to coils 201 and 202.

Second upper structural member 901 is supported over upper structural member 100. Second upper structural member 901 includes coils 902–903, magnetic pathways 904–905 and substrate 906. To unlatch platform 113 from the latched position illustrated in FIG. 10, a current is applied to coils 902 and 903, thereby asserting an upward force on pole pieces 102 and 103 and pulling platform 113 upward out of its latched position.

In an alternative embodiment, second upper structural member 901 is eliminated, and pole pieces 102 and 103 are made of a permanent magnetic material. Platform 113 is then pulled downward into a latched position by applying a current having a first polarity to coils 201 and 202. Platform 113 is pushed upward into an unlatched condition by applying a current having a second polarity (opposite the first polarity) to coils 201 and 202.

Although the invention has been described in connection with several embodiments, it is understood that this invention is not limited to the embodiments disclosed, but is capable of various modifications which would be apparent to a person skilled in the art. For example, although the fabrication of a single micro-relay has been described, it is understood that the methods described herein facilitate the batch fabrication of a plurality of micro-relays. That is, a plurality of upper structural members 100 can be simultaneously fabricated on a silicon wafer, a plurality of lower structural members 200 can be simultaneously be fabricated on a single substrate, and the silicon wafer can be joined to the single substrate to form a plurality of micro-relays. This plurality of micro-relays can be diced into individual relays, or maintained as an integrated array of relays to perform a specific routing or multiplexing function. Such an integrated array of relays can be used to implement functions in larger systems, such as microelectronics automatic testing systems or communication switching systems.

Figure 11A:
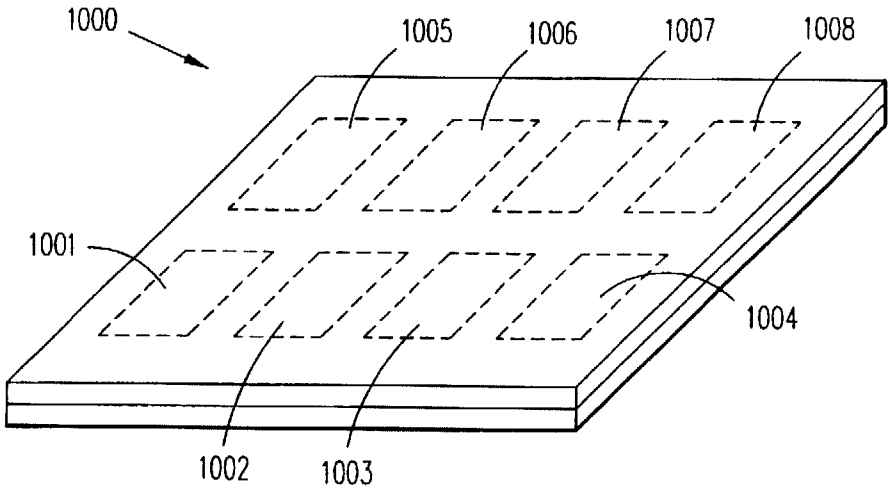
FIGS. 11*a*–11*c* are isometric views of micro-relay arrays in accordance with the invention.
Figure 11B:
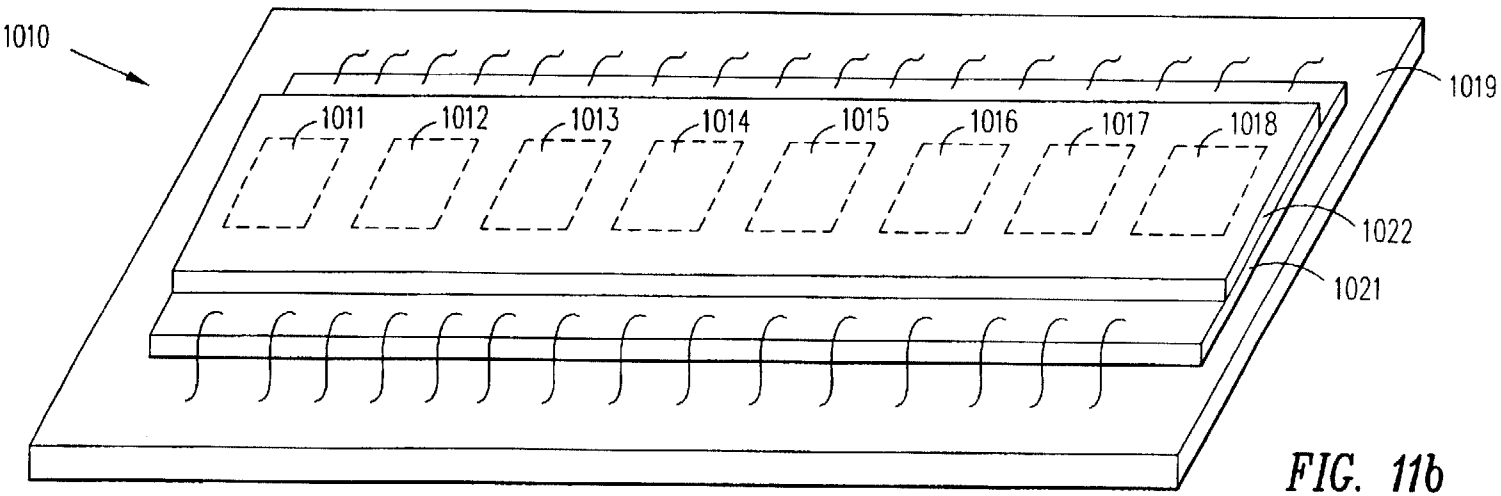

FIG. 11*a* illustrates an integrated array 1000 of micro-relays 1001–1008 (represented by dashed lines). The electrically conductive contact elements of micro-relays 1001–1008 are interconnected during fabrication to form the desired switching circuit. FIG. 11*b* illustrates an integrated array 1010 which includes lower structural member 1021 and upper structural member 1022 in accordance with another embodiment. Micro-relays 1011–1018 of array 1010 are aligned in an in-line configuration. Array 1010 is bonded flat onto printed circuit board 1019 in FIG. 11*b*. Wires are bonded between lower structural member 1021 and printed circuit board 1019 to provide the desired connections to array 1010.

Figure 11C:
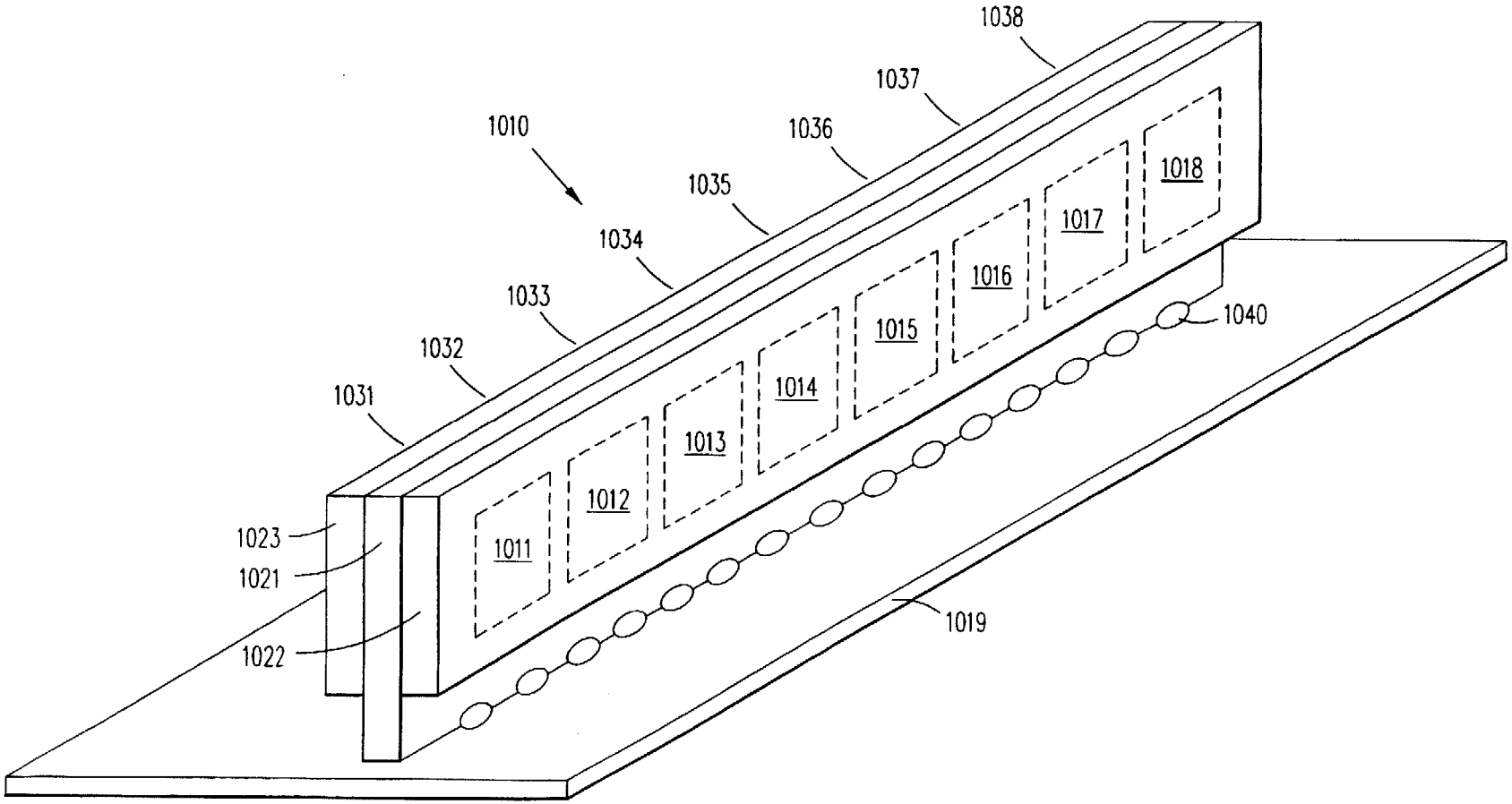

As illustrated in FIG. 11*c*, array 1010 can also be set on its edge and bonded to printed circuit board 1019. Solder bumps, such as solder bump 1040, are used to electrically couple micro-relays 1011–1018 to printed circuit board 1019. In this embodiment, a second upper structural member 1023 can be bonded to the back side of lower structural member 1021. The back side of lower structural member 1021 is processed in the same manner as the front side of lower structural member 1021, such that the back side of lower structural member 1021 includes coils, magnetic pathways and conductive contact elements. As a result, additional micro-relays 1031–1038 (not visible in FIG. 11*c*) are created at the back side of lower structural member 1021. This embodiment effectively doubles the number of micro-relays which can be located in a given area. Such an embodiment is exceptionally cost effective when the lower structural member 1021 is a ferrite wafer, since there is no additional processing required to deposit magnetic pathways for micro-relays 1031–1038.

Figure 12A:
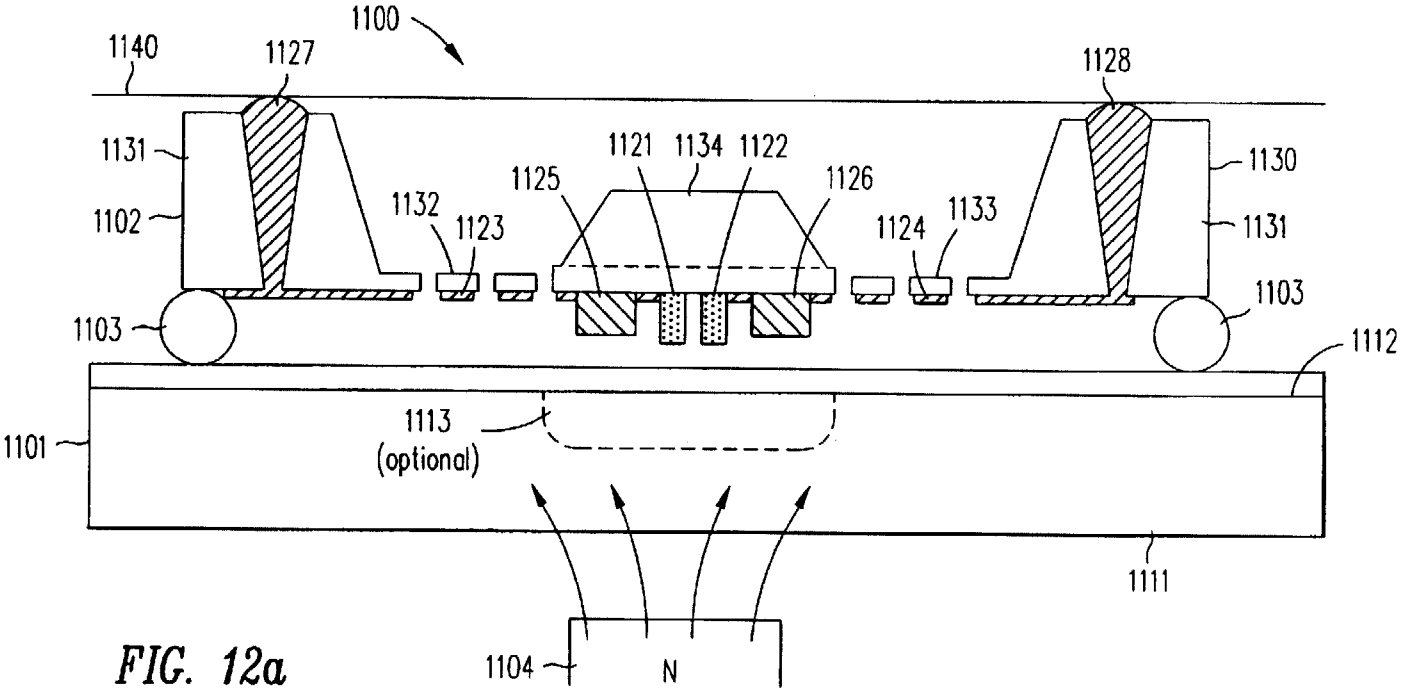
FIG. 12*a* is a cross sectional view of a micro-relay in accordance with an alternative embodiment.

In another variation, a micro-relay is magnetically actuated by an external magnetic field. The external magnetic field can be created by an external electromagnetic circuit or by a permanent magnet. FIG. 12*a* illustrates a micro-relay 1100 in accordance with this variation. Micro-relay 1100 includes lower structural member 1101, upper structural member 1102, spacers 1103, and external magnetic source 1104. Lower structural member 1101 includes a cover wafer 1111 made of silicon or another suitable material, an electrically conductive layer 1112, and optional magnetic pathways 1113. Spacers 1103 are typically located in an adhesive which joins the upper and lower structural members. Upper structural member 1102 includes contact pads 1121–1122, conductive traces 1123–1124, pole pieces 1125–1126, conductive via plugs 1127–1128 and monocrystalline silicon structural member 1130. Silicon structural member 1130 includes frame portion 1131, spring elements 1132–1133 and platform 1134.

External magnet 1104 is either turned on (when magnet 1104 is an electromagnet) or brought into proximity with micro-relay 1100 (when magnet 1104 is a permanent magnet) to actuate micro-relay 1100. The magnetic field of magnet 1104 attracts permalloy pole pieces 1125–1126, thereby pulling contact pads 1121–1122 into contact with conductive layer 1112. Conductive layer 1112 thereby provides a conductive path between contact pads 1121–1122. Because the only processing required for lower structural member 1101 is the formation of conductive layer 1112, processing costs are reduced. In addition, because conductive layer 1112 covers wafer 1111, there is no need for lateral alignment when bonding the upper structural member 1102 and the lower structural member 1101. In an alternative embodiment, magnetic pathway 1113 (e.g., a permalloy filled trench) is formed in cover wafer 1111 to route and concentrate the external magnetic field introduced by magnet 1104, thereby increasing the efficiency of micro-relay 1100.

Contact pads 1121–1122 are electrically coupled to conductive traces 1123–1124. Conductive traces 1123–1124 extend from platform 1134, over spring elements 1132–1133, to frame 1131. Via plugs 1127–1128 extend through frame 1131 and connect to conductive traces 1123–1124. Via plugs 1127–1128 are bonded to printed circuit board 1140, thereby providing an electrical connection from printed circuit board 1140 to micro-relay 1100. After bonding, micro-relay 1100 and printed circuit board 1140 can be sealed using, for example, a polymer conformal coating.

Micro-relay 1100 can be used to replace existing reed-type magnetic switches such as those used in burglar alarm systems, automobile doors, control panel switches, magnetic locks, electric toothbrushes, microwave and refrigerator doors, blenders, food processors, can openers and other kitchen appliances. Micro-relay 1100 is advantageously small, reliable and can be made waterproof and explosion proof.

Figure 12B:
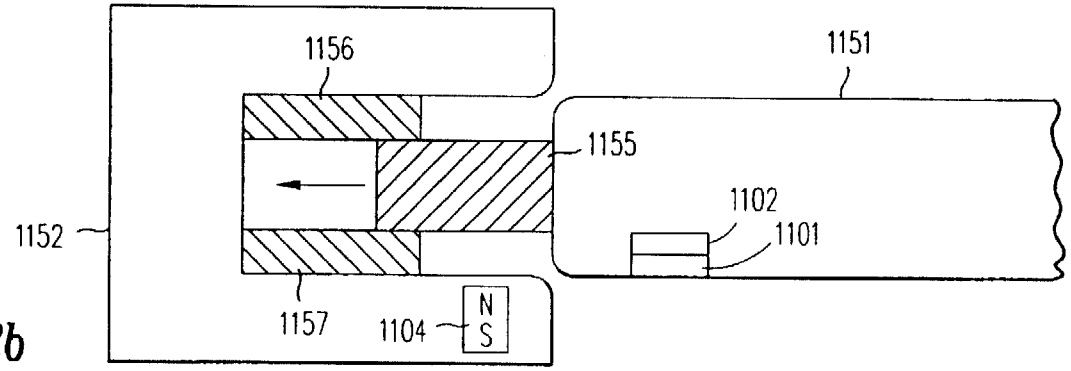
FIG. 12*b* is a cross sectional view of a connector using the micro-relay of FIG. 12*a*.

In a particular application, illustrated in FIG. 12*b*, micro-relay 1100 is used in an electrical connector or circuit board to turn the supply power on and off. To do this, the lower structural member 1101 and the upper structural member 1102 are integrated into a male connector element or a printed circuit board 1151. Magnet 1104 is then built into the female connector element or the card cage 1152. In this application, the power remains off until lower structural member 1101 and upper structural member 1102 are brought into close proximity with magnet 1104. By the time this condition exists, electrical connector 1155 of male connector element 1151 has already made contact with electrical connectors 1156–1157 of female connector element 1152. As a result, power is not turned on until contact has been established between electrical connectors 1155 and 1156–1157. Similarly, when male connector 1151 is pulled apart from female connector 1152, the power to male connector 1151 is disconnected when upper and lower structural members 1101–1102 are moved out of proximity with magnet 1104. The configuration of the various elements ensures that the power is disconnected before electrical connector 1155 is disconnected from electrical connectors 1156–1157.

Figure 13:
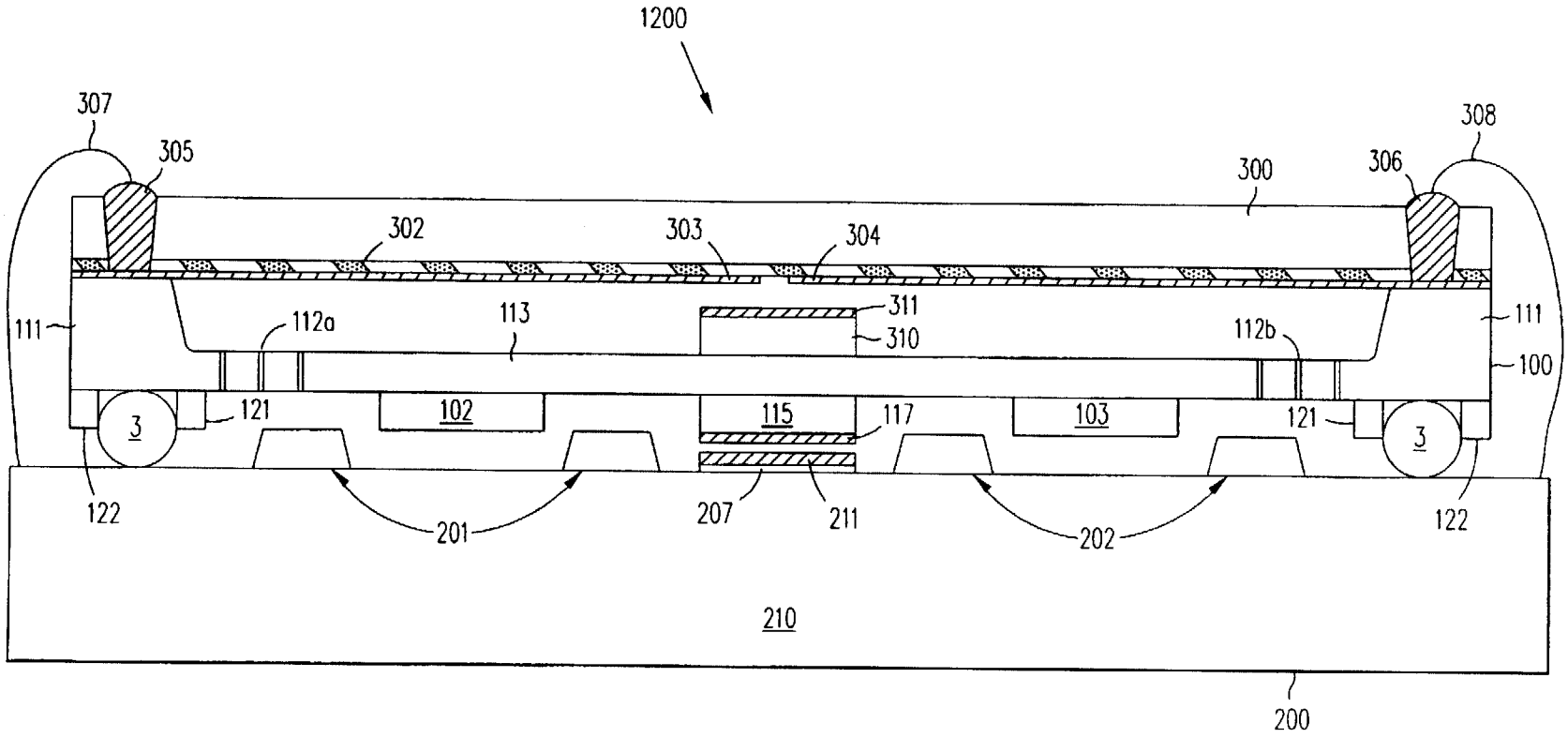
FIG. 13 is a cross sectional view of a micro-relay in accordance with another embodiment.

FIG. 13 illustrates a micro-relay 1200 in accordance with yet another variation. Micro-relay 1200 includes many of the same elements as micro-relay 1 (FIG. 5*a*). Thus, similar elements in micro-relays 1 and 1200 are labeled with similar reference numbers. Frame portion 111 of upper structural member 100 is formed using the method previously described in connection with FIGS. 6*a*–6*c* (although this is not necessary). In micro-relay 1200, pole pieces 102 and 103 are made of a permanent magnetic material. Coils 201 and 202 are wound such that a current flowing in a first direction through coils 201 and 202 causes permanent magnets 102–103 to be attracted to lower structural member 200. A current flowing in a second direction (opposite to the first direction) through coils 201 and 202 causes permanent magnets 102–103 to be repelled from lower structural member 200.

A third structural member 300 is mounted over upper structural member 100. Although structural member 300 is shown as being connected directly to frame portion 111 of upper structural member 100, the methods previously described for connecting upper structural member 100 and lower structural member 200 can also be used. Third structural member 300 includes a substrate 301, an insulating layer 302, contact elements 303–304 and via plugs 305–306. A spacer 310 and a bridge pad 311 are formed on the upper surface of platform 113, such that bridge pad 311 is positioned adjacent to contact elements 303 and 304 of third structural member 300. When permanent magnets 102 and 103 are repelled from lower structural member 200, bridge pad 311 is forced upward into contact with contact elements 303 and 304, thereby completing an electrical connection. Contact elements 303–304 extend to the edges of third structural member 300. Via plugs 305 and 306 extend through substrate 301 and insulating layer 302 to provide a connection to contact elements 303 and 304. Wires 307 and 308 are bonded to connect via plugs 305 and 306 to circuitry on lower structural member 200. In this manner, micro-relay 1200 can be used to form a three position switch.

Figure 14:
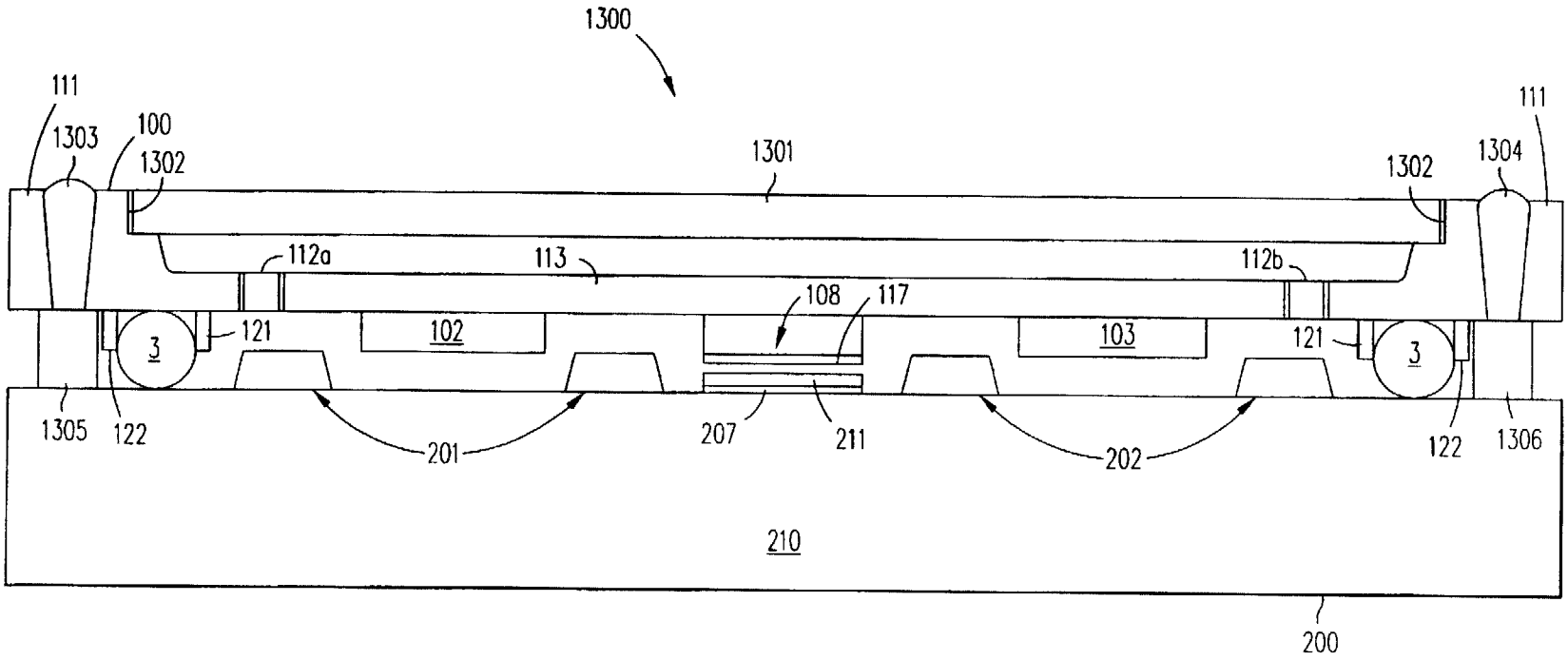
FIG. 14 is a cross sectional view of a micro-relay in accordance with another embodiment.

FIG. 14 illustrates a micro-relay 1300 in accordance with yet another variation. Micro-relay 1300 includes many of the same elements as micro-relay 1 (FIG. 5*a*). Thus, similar elements in micro-relays 1 and 1300 are labeled with similar reference numbers. Frame portion 111 of upper structural member 100 is formed using the method previously described in connection with FIGS. 6*a*–6*c*. A step 1302 is etched into frame portion 111 and a cover 1301 is fixed into step 1302 using an adhesive. Cover 1301 can be a material such as metal or silicon. Cover 1301 provides a seal which protects micro-relay 1301. Solder bumps 1303 and 1304 extend through frame portion 111 and contact electrically conductive elements 1305 and 1306, respectively. Conductive elements 1305 and 1306 provide electrical connections to two of the conductive elements formed on the upper surface of lower structural member 200. For example, conductive elements 1305 and 1306 can contact the traces leading from contact elements 211 and 212 (See, FIG. 3). Conductive elements 1305 can alternatively contact traces 221 and 222, which are coupled to coils 203 and 202, respectively (See, FIG. 3).

Conductive elements 1303–1304 can be formed by a conductive adhesive, traces formed on substrate 210 or by solder dropped through the vias formed for via plugs 1303–1304. Via plugs 1303–1304 are formed by depositing a conductive material, such as solder, into openings in upper structural member 100. In one embodiment, solder is electroplated into the via plug openings (onto conductive elements 1305–1306) to form via plugs 1303–1304.

Figure 15A:
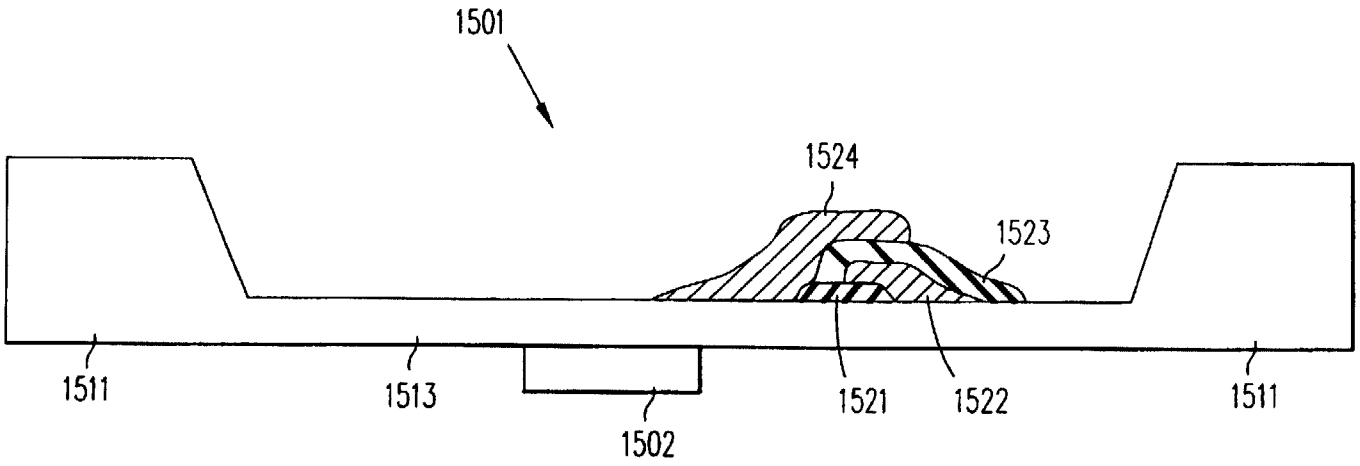
FIGS. 15*a*–15*d* illustrate various views of a micro-relay in accordance with another embodiment.

FIGS. 15*a*–15*d* illustrate a micro-relay 1500 in accordance with yet another embodiment. FIG. 15*a* illustrates the fabrication of an upper structural member 1501 of micro-relay 1500. Upper structural member 1501 includes a monocrystalline silicon frame 1511 and platform 1513. A pole piece 1502 is formed on the underside of platform 1513. A layer 1521 made of silicon oxide or a polymer is formed on the upper surface of platform 1513. An electrically conductive contact element 1522 is formed over layer 1521. A second layer 1523 made of silicon oxide or a polymer is formed over contact element 1522. A second electrically conductive contact element 1524 is formed over layer 1523. In one embodiment, contact elements 1522 and 1524 are gold.

Figure 15B:
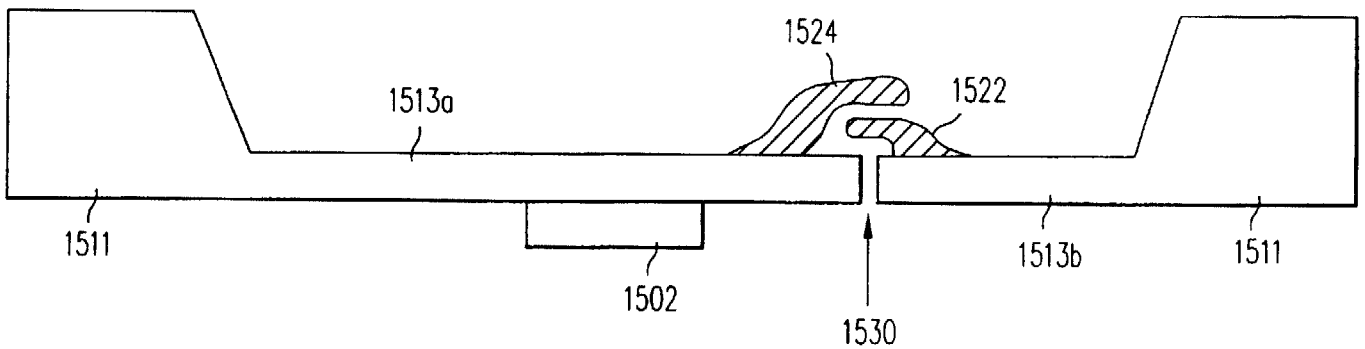
Figure 15C:
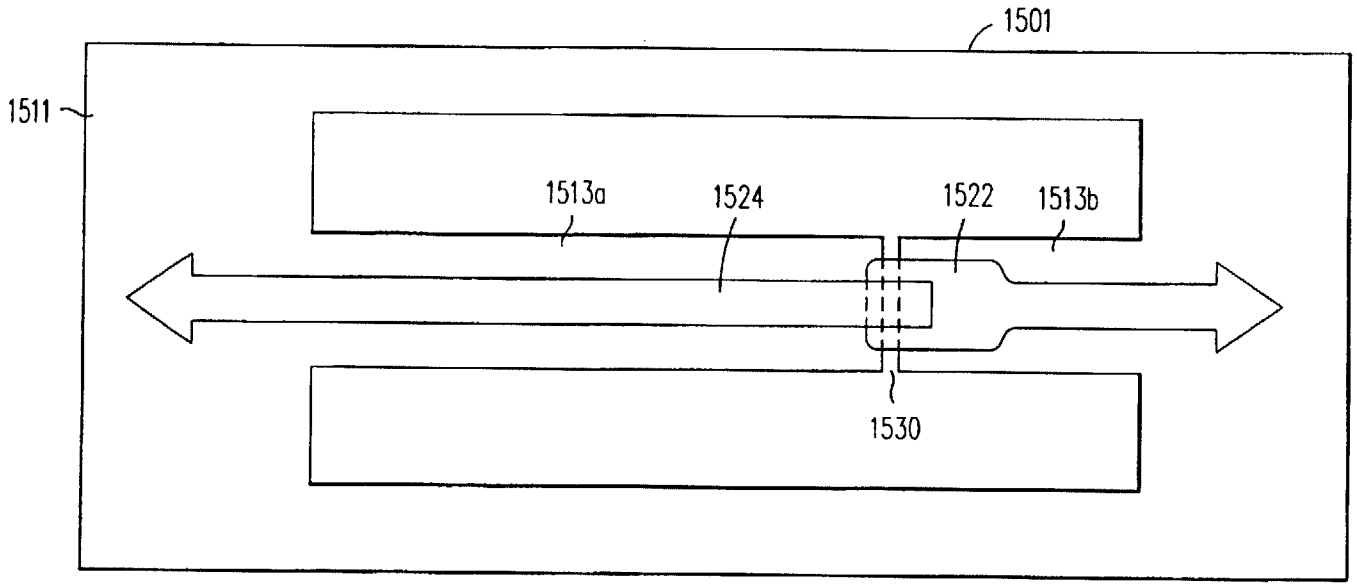
Figure 15D:
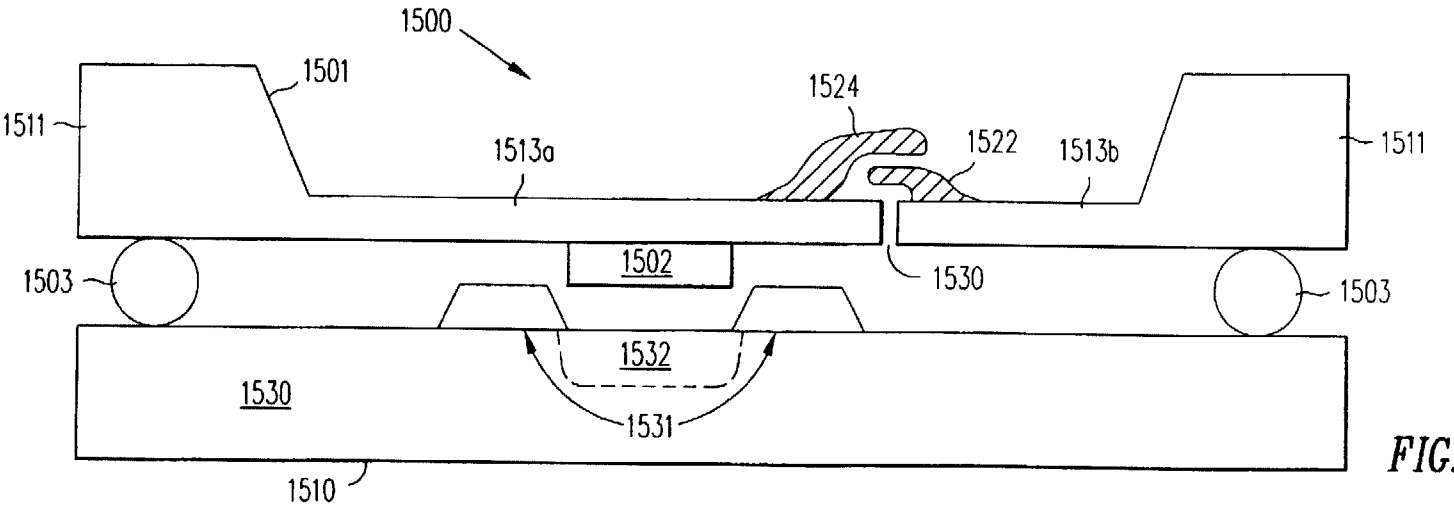

As shown in FIGS. 15*b* and 15*c*, the resulting structure is etched from the underside, thereby creating gap 1530 and removing layers 1521 and 1523. This etch also patterns platform 1513 into two monocrystalline silicon beams 1513*a* and 1513*b*. After removing layers 1521 and 1523, contact elements 1522 and 1524 are electrically isolated by a gap. As shown in FIG. 15*d*, upper structural member 1501 is coupled to a lower structural member 1510 by spacers 1503. Lower structural member 1510 includes a substrate 1530 having a coil 1531 and magnetic pathway 1532. When a current is applied to coil 1531, beam 1513*a* flexes downward as pole piece 1502 is pulled toward lower structural member 1510. As a result, contact element 1524 is pulled down into contact with contact element 1522. When the current is no longer applied to coil 1531, beam 1513*a* returns upward to its original position, thereby separating contact elements 1522 and 1524. Because beams 1513*a* and 1513*b* are relatively narrow (e.g., 30 μm), a large number of micro-relays similar to micro-relay 1500 can be packed into a small area.

Figure 16A:
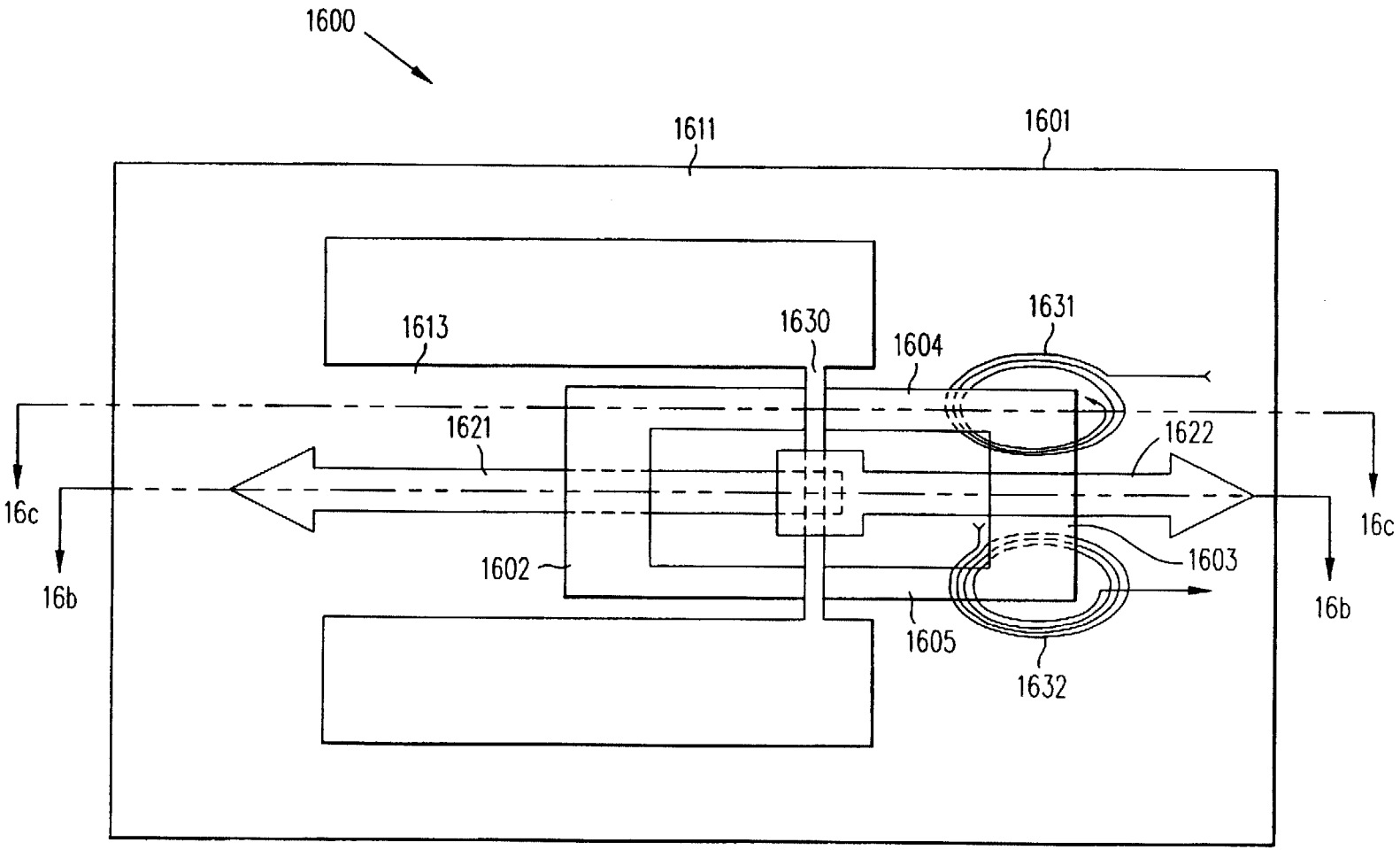
FIGS. 16*a*–16*c* illustrate various views of a micro-relay in accordance with yet another embodiment.
Figure 16B:
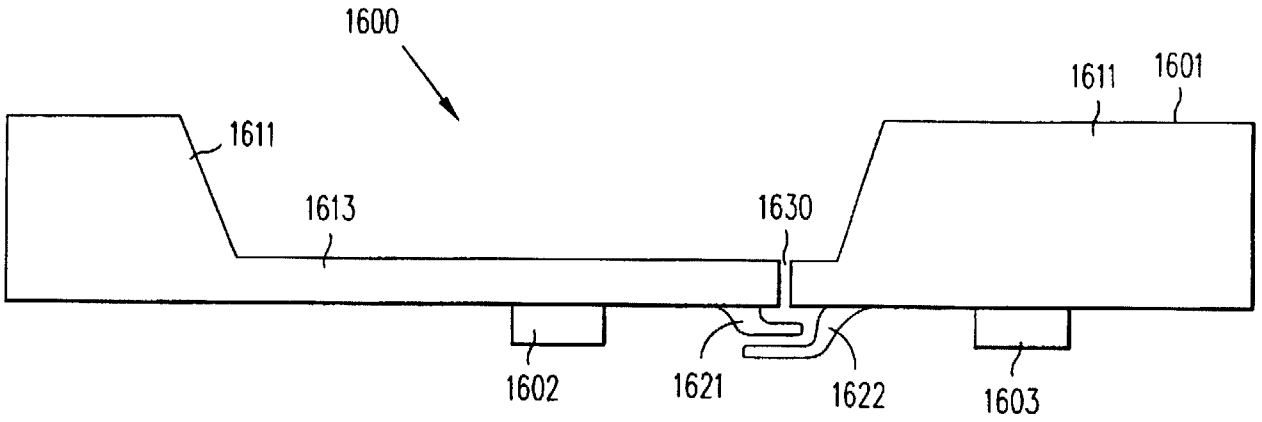
Figure 16C:
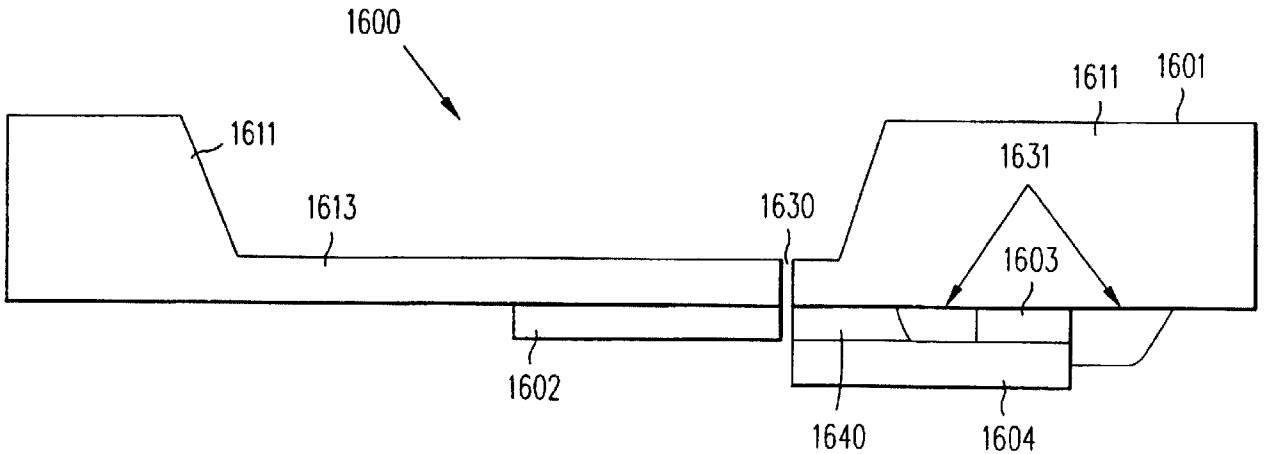

FIGS. 16*a*–16*c* illustrate yet another micro-relay 1600 in accordance with the invention. Micro-relay 1600 advantageously implements all micro-relay elements on a single wafer 1601. FIG. 16*a* is a bottom view of micro-relay 1600. FIG. 16*b* is a cross sectional view of micro-relay 1600 along section line 16*b*–16*b* of FIG. 16*a*. FIG. 16*c* is a cross sectional view of micro-relay 1600 along section line 16*c*–16*c* of FIG. 16*a*.

As shown in FIG. 16*a*, monocrystalline silicon beam 1613 extends out from frame portion 1611. Pole piece 1602 and electrically conductive element 1621 are formed on the underside of beam 1613. A gap 1630 separates beam 1613 from a portion of frame 1611. Pole pieces 1603–1605, electrically conductive element 1622 and coils 1631–1632 are formed on the underside of frame 1611.

As shown in FIG. 16*b*, conductive element 1621 is normally separated from conductive element 1622. As shown in FIG. 16*c*, coil 1631 is formed around pole pieces 1603 and 1604. Similarly, coil 1632 is formed around pole pieces 1603 and 1605. Coils 1631 and 1632 are connected such that a current applied to these coils 1631–1632 magnetizes pole pieces 1603–1605, such that one of pole pieces 1604 and 1605 has one magnetic polarity (e.g., north), and the other one of pole pieces 1604 and 1605 has an opposite magnetic polarity (e.g., south). A spacer 1640 is formed between wafer 1601 and the ends of pole pieces 1604 and 1605, thereby positioning the ends of pole pieces 1604 and 1605 lower than the ends of pole piece 1602 as shown in FIG. 16*c*. Spacer 1640 is a non-permeable material which does not provide a magnetic pathway. As a result, when pole pieces 1604 and 1605 are magnetized, a downward force is applied to pole piece 1602 (as pole piece 1602 attempt to align with pole pieces 1604–1605). This downward force causes beam 1613 to flex downward, thereby pulling contact element 1621 down into contact with contact element 1622. In one embodiment, beam 1613 has a length of approximately 150 μm.

In yet other variations of micro-relay 1 (FIG. 5*a*), other contact configurations are used. In a specific configuration, a single contact pad is located on upper structural member 100 and a single contact pad is located on lower structural member 200. Traces extend from each of these contact pads to the desired electrical circuitry. When the micro-relay is actuated, the two contact pads come into contact, thereby completing the electrical circuit.

In other variations, other numbers of contact pads are used. Although the embodiment of FIG. 5*a* uses two contact pads 211 and 212, additional contact pads can be added. Furthermore, other numbers of coils and pole pieces can be used. Thus, the invention is limited only by the following claims.

What is claimed is:

1. A micro-relay comprising:

a substrate having a magnetic pathway located therein;

one or more coils located on the substrate over the magnetic pathway, wherein a current applied to the one or more coils magnetizes the magnetic pathway;

a first electrically conductive contact pad coupled to the substrate, the first contact pad being electrically insulated from the substrate;

a flexible monocrystalline structure suspended over the substrate;

a second electrically conductive contact pad coupled to the monocrystalline structure and located above the first contact pad, the second contact pad being positioned such that when the monocrystalline structure flexes toward the substrate, the second contact pad touches the first contact pad, thereby providing an electrical connection between the first and second contact pads; and a pole piece coupled to the monocrystalline structure and positioned above the one or more coils, whereby a current applied to the one or more coils generates an electromagnetic force which flexes the monocrystalline structure toward the substrate, thereby causing the second contact pad to touch the first contact pad.

2. The micro-relay of claim 1, wherein the monocrystalline structure comprises:

a frame portion located about a perimeter of the monocrystalline structure;

a platform portion which is laterally surrounded by the frame portion, the pole piece and the second contact pad being located on the platform portion; and a plurality of spring elements extending between the frame portion and the platform portion.

3. The micro-relay of claim 2, wherein the spring elements have a serpentine shape.

4. The micro-relay of claim 2, further comprising a cover located over the monocrystalline structure.

5. The micro-relay of claim 1, wherein the monocrystalline structure is continuous.

6. The micro-relay of claim 5, wherein the monocrystalline structure is capable of buckling and latching when the monocrystalline structure flexes toward the substrate.

7. The micro-relay of claim 1, wherein the monocrystalline structure has a thickness of less than 100 μm.

8. The micro-relay of claim 1, further comprising at least one pole tip extending from the pole piece.

9. The micro-relay of claim 1, further comprising a pole tip coupled to the substrate, wherein one of the one or more coils laterally surrounds the pole tip.

10. The micro-relay of claim 1, wherein the substrate comprises a ferromagnetic material.

11. The micro-relay of claim 1, wherein the substrate comprises:

a monocrystalline silicon substrate having a trench located therein; and a layer of ferromagnetic material located in the trench, wherein the ferromagnetic material forms the magnetic pathway.

12. The micro-relay of claim 1, wherein the pole piece comprises a ferromagnetic material.

13. The micro-relay of claim 1, wherein the pole piece comprises a permanent magnet.

14. The micro-relay of claim 1, wherein the monocrystalline structure comprises monocrystalline silicon.

15. A micro-relay comprising:

a substrate;

a first electrically conductive contact pad coupled to the substrate, the first contact pad being electrically insulated from the substrate;

a flexible monocrystalline structure suspended over the substrate;

a second electrically conductive pad coupled to the monocrystalline structure and located above the first contact pad, the second contact pad being positioned such that when the monocrystalline structure flexes toward the substrate, the second contact pad touches the first contact pad, thereby providing an electrical connection between the first and second contact pads; and means for generating a magnetic force which pulls the monocrystalline structure towards the substrate, thereby causing the second contact pad to touch the first contact pad.

16. The micro-relay of claim 15, wherein the means for generating comprises an electromagnet.

17. The micro-relay of claim 16, wherein the electromagnet is coupled to the substrate.

18. The micro-relay of claim 16, wherein the electromagnet is positioned away from the substrate.

19. The micro-relay of claim 15, wherein the means for generating comprises a permanent magnet.

20. The micro-relay of claim 15, wherein the monocrystalline structure comprises monocrystalline silicon.

21. A micro-relay comprising:

a substrate;

a monocrystalline semiconductor structure suspended above the substrate;

means for generating a magnetic force which moves the monocrystalline structure relative to the substrate; and means for establishing an electrical connection when the monocrystalline structure is moved by the means for generating, the means for establishing an electrical connection being separate from the means for generating.

22. A coil comprising:

a planar substrate;

a first winding layer located over the substrate, the first winding layer having an innermost trace and an outermost trace;

a first insulating spacer located adjacent to the innermost trace of the first winding layer;

a second insulating spacer located adjacent to the outermost trace of the first winding layer; and a first insulating layer located over the first winding layer and the first and second spacers.

23. The coil of claim 22, further comprising:

a second winding layer located over the first insulating layer, the second winding layer having an innermost trace and an outermost trace;

a third insulating spacer located adjacent to the innermost trace of the second winding layer;

a fourth insulating spacer located adjacent to the outermost trace of the second winding layer; and a second insulating layer located over the second winding layer and the third and fourth spacers.

24. The coil of claim 22, wherein the first and second spacers comprise photoresist material.

25. A method of operating a micro-relay comprising the steps of:

generating an electromagnetic force;

using the electromagnetic force to flex a monocrystalline structure; and closing an electrical circuit when the monocrystalline structure is flexed, wherein the closing is achieved by a contact element located on the monocrystalline structure.

26. A method of fabricating a micro-relay comprising the steps of:

providing a substrate having a magnetic pathway;

forming one or more coils over the magnetic pathway;

forming a first electrically conductive contact element over the substrate;

forming a flexible monocrystalline structure;

forming a pole piece on the monocrystalline structure;

forming a second electrically conductive contact element on the monocrystalline structure;

joining the monocrystalline structure to the substrate such that the monocrystalline structure is suspended over substrate, the pole piece is located over the one or more coils and the second contact element is located over the first contact element.

27. A method of fabricating a coil over a planar substrate comprising the steps of:

forming a first winding layer of the coil over the substrate, the first winding layer having an innermost trace and an outermost trace;

forming a first electrically insulating spacer adjacent to the outermost trace;

forming a second electrically insulating spacer adjacent to the innermost trace; and forming a first insulating layer over the first winding layer and the first and second spacers.

28. The method of claim 27, further comprising the steps of forming a second insulating layer over the substrate, and forming the first winding layer and the first and second spacers over the second insulating layer.

29. The method of claim 27, wherein the steps of forming the first winding layer and the first and second spacers further comprise the steps of:

forming a photoresist layer over the substrate;

exposing the photoresist layer through a first reticle which defines the first winding layer;

developing the photoresist layer to form an opening in the photoresist layer;

forming an electrically conductive material in the opening, thereby forming the first winding layer;

exposing the photoresist layer through a second reticle which defines the first and second spacers; and developing the photoresist layer, thereby leaving portions of the photoresist layer as the first and second spacers.

30. The method of claim 29, further comprising the step of baking the portions of the photoresist layer.

31. The method of claim 27, further comprising the steps of:

forming a second winding layer of the coil over the first insulating layer, the second winding layer having an innermost trace and an outermost trace;

forming a third electrically insulating spacer adjacent to the outermost trace of the second winding layer;

forming a fourth electrically insulating spacer adjacent to the innermost trace of the second winding layer; and forming a second insulating layer over the second winding layer and the third and fourth spacers.

32. A micro-relay comprising:

a monocrystalline structure comprising a frame portion and a flexible beam portion extending from the frame portion;

a first contact element located on the beam portion;

a second contact element separated from the first contact element;

means for flexing the beam portion such that the first contact element contacts the second contact element, the means for flexing being coupled to the beam portion.

33. The micro-relay of claim 32, wherein the means for flexing comprise:

a pole piece formed on the beam portion; and an element for generating a magnetic field located adjacent to the pole piece.

34. The micro-relay of claim 33, wherein the element for generating a magnetic field comprises:

a structural member coupled to the monocrystalline structure, the structural member having a magnetic pathway located therein; and a coil coupled to the structural member, the coil being located over the magnetic pathway and being positioned adjacent to the pole piece.

35. The micro-relay of claim 32, wherein the means for flexing comprises:

a first pole piece coupled to the beam portion;

a second pole piece coupled to the frame portion, wherein a gap separates the first and second pole pieces, the first pole piece being offset from the second pole piece across the gap; and a coil located around the second pole piece.

* * * * *